US006214505B1

(12) United States Patent
Ong et al.

(10) Patent No.: US 6,214,505 B1
(45) Date of Patent: Apr. 10, 2001

(54) IMAGING MEMBERS

(75) Inventors: Beng S. Ong; Yu Qi; Cheng-Kuo Hsiao, all of Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/619,050

(22) Filed: Jul. 18, 2000

(51) Int. Cl.[7] ..... G03G 5/047

(52) U.S. Cl. ..... 430/58.65; 430/59.1; 430/59.6; 430/96; 430/120

(58) Field of Search ..... 430/58.15, 59.1, 430/59.6, 96, 120

(56) References Cited

U.S. PATENT DOCUMENTS

| | | | | |
|---|---|---|---|---|
| 3,121,006 | | 2/1964 | Middleton et al. | 430/31 |
| 3,871,882 | | 3/1975 | Wiedemann | 430/58.5 |
| 4,081,274 | | 3/1978 | Horgan | 430/58.8 |
| 4,115,116 | | 9/1978 | Stolka et al. | 430/58.8 |
| 4,233,384 | | 11/1980 | Turner et al. | 430/58.75 |
| 4,265,990 | | 5/1981 | Stolka et al. | 430/58.8 |
| 4,297,424 | | 10/1981 | Hewitt | 430/57.8 |
| 4,299,897 | | 11/1981 | Stolka et al. | 430/58.8 |
| 4,304,829 | | 12/1981 | Limburg et al. | 430/58.3 |
| 4,306,008 | | 12/1981 | Pai et al. | 430/58.8 |
| 4,393,190 | | 7/1983 | Tyrell et al. | 528/170 |
| 4,419,427 | | 12/1983 | Graser et al. | 430/58.6 |
| 4,429,029 | | 1/1984 | Hoffmann et al. | 430/58.6 |
| 4,555,463 | | 11/1985 | Hor et al. | 430/58.8 |
| 4,587,189 | | 5/1986 | Hor et al. | 430/58.8 |
| 4,609,605 | | 9/1986 | Lees et al. | 430/58.1 |
| 4,869,988 | | 9/1989 | Ong et al. | 430/58.65 |
| 4,921,773 | | 5/1990 | Melnyk et al. | 430/132 |
| 4,937,164 | | 6/1990 | Duff et al. | 430/58.8 |
| 4,946,754 | | 8/1990 | Ong et al. | 430/58.65 |
| 5,139,910 | | 8/1992 | Law et al. | 430/58.8 |
| 5,378,570 | * | 1/1995 | Kobayashi et al. | 430/59.6 |
| 5,482,811 | | 1/1996 | Keoshkerian et al. | 430/135 |
| 5,645,965 | | 7/1997 | Duff et al. | 430/58.8 |
| 5,683,842 | | 11/1997 | Duff et al. | 430/58.7 |
| 6,027,846 | * | 2/2000 | Shimada et al. | 430/96 |

* cited by examiner

*Primary Examiner*—Roland Martin
(74) *Attorney, Agent, or Firm*—E. O. Palazzo

(57) ABSTRACT

A photoconductive imaging member containing a photogenerating layer and a charge transport layer, and wherein the charge transport layer contains a poly(imide-carbonate) resin binder of (I) or (II)

(I)

(II)

wherein A, B and E are divalent linkages; D is a trivalent linkage in (I) and a tetravalent linkage in (II); and x and y represent mole fractions wherein the sum of x+y is equal to 1.

26 Claims, No Drawings

IMAGING MEMBERS

RELATED PATENTS AND COPENDING APPLICATION

There are illustrated in U.S. Pat. No. 5,645,965, the disclosure of which is totally incorporated herein by reference, photoconductive imaging members with symmetrical dimeric perylenes, and in U.S. Pat. No. 5,683,842, the disclosure of which is totally incorporated herein by reference, photoconductive imaging members with unsymmetrical dimer perylenes. In U.S. Pat. No. 5,482,811, the disclosure of which is totally incorporated herein by reference, there are illustrated imaging members with photogenerating components of hydroxygallium phthalocyanines and aryl amine charge transport components. These patents also disclose resin binders for the photogenerating and charge transport components.

In copending application U.S. Ser. No. 09/165,595, the disclosure of which is totally incorporated herein by reference, there is illustrated a photoconductive imaging member comprised of an unsymmetrical perylene of the formula

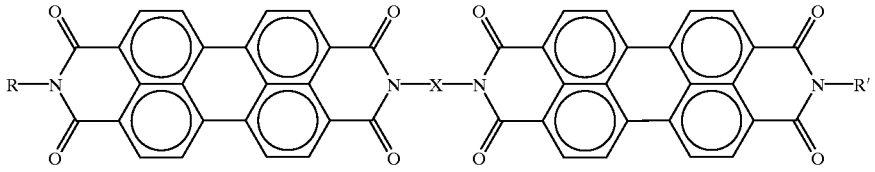

wherein each R and R' are dissimilar and wherein said R and R' are hydrogen, alkyl, cycloalkyl, substituted alkyl, aryl, substituted aryl, aralkyl, and substituted aralkyl, and X represents a symmetrical bridging component.

A number of the appropriate components of the imaging members of the above patents and patent application, such as the substrates, charge transport components, photogenerating pigments, and the like, can be selected for the imaging members of the present invention.

BACKGROUND OF THE INVENTION

The present invention is directed generally to imaging members, such as photoconductive imaging members, and which members are comprised of charge transport component binders of, for example, poly(imide-carbonates). The aforementioned poly(imide-carbonate) binders can possess a number of advantages including, for example, resistance to mechanical and corrosive wear induced and caused by the application of an electrochemically aggressive bias charging roll (BCR), and enhanced photoreceptor life with substantially no compromise in electrical performance characteristics. When a BCR is utilized as the charging device, the photoreceptor surface is usually subjected to severe chemical attacks from the corrosive species generated during charging, leading to photoreceptor surface wear during cleaning. For example, when utilizing BCR charging and polycarbonate Z as the transport layer binder, the photoreceptor life is generally about 150,000 to about 250,000 imaging cycles. The poly(imide-carbonate)-based photoreceptors of the present invention generally exhibit a two fold enhancement, that is about 300,000 to about 500,000 imaging cycles in life over the polycarbonate Z-based photoreceptors under similar BCR charging conditions. Various imaging and electrophotographic digital apparatus and processes can incorporate the members of the present invention, and wherein the developed images obtained can be of high resolution, especially in, for example, high speed, over about 65 copies per minute, machines such as the Xerox Corporation 5090.

PRIOR ART

Generally, layered photoresponsive imaging members are described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. For example, charge transport layers comprised of aryl diamines dispersed in polycarbonates, like MAKROLON® are known. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent can comprise resins which are substantially incapable of transporting for any significant distance injected charge carriers generated by the photoconductive particles.

There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a nonhalogenated perylene pigment photogenerating component. Both of the aforementioned patents disclose an aryl amine component as a hole transport layer, and wherein there can be selected a number of resin binders.

Moreover, there are disclosed in U.S. Pat. No. 4,419,427 electrographic recording media with a photosemiconductive double layer comprised of a first layer containing charge carrier perylene diimide dyes, and a second layer with one or more compounds which are charge transporting materials when exposed to light.

U.S. Pat. No. 4,419,427 discloses the use of highly-loaded dispersions of perylene bisimides, with bis(2,6-dichlorophenylimide) being a preferred material, in binder resins as charge generating layers in devices overcoated with a charge transporting layer such as a poly(vinylcarbazole).

U.S. Pat. No. 4,429,029 illustrates the use, in devices similar to those of the '427 patent, of bisimides and bisimidazo perylenes in which the perylene nucleus is halogenated, preferably to an extent where 45 to 75 percent of the perylene ring hydrogens have been replaced by halogen. U.S. Pat. No. 4,587,189, the disclosure of which is totally incorporated herein by reference, illustrates layered photoresponsive imaging members prepared with dispersions or, preferably, vacuum evaporated thin coatings of cis- and trans-bis(benzimidazo)perylene (4a, X=1,2-phenylene) and other perylenes overcoated with hole transporting compositions comprised of a variety of N,N,N',N'-tetraaryl-4,4'-diaminobiphenyls. U.S. Pat. No. 4,937,164 illustrates the use of perylene bisimides and bisimidazo pigments in which the 1,12-and/or 6,7 position of the perylene nucleus is bridged by one or two sulfur atoms wherein the pigments in the CGL (charge generating layer) layers are either vacuum evaporated or dispersed in binder resins and thereover a layer of tetraaryl biphenyl hole transporting molecules.

In U.S. Pat. No. 4,869,988 and U.S. Pat. No. 4,946,754, the disclosures of which are totally incorporated herein by reference, there are described layered photoconductive imaging members with transport layers incorporating, for example, biarylyl diarylamines, N,N-bis(biarylyl)anilines, and tris(biarylyl)amines as charge transport compounds. In the above-mentioned patents, there are disclosed improved layered photoconductive imaging members comprised of a supporting substrate, a photogenerating layer optionally dispersed in an inactive resinous binder, and in contact therewith a charge transport layer comprised of the above-mentioned charge transport compounds, or mixtures thereof dispersed in a number of resinous binders.

It is also indicated in the aforementioned patents that there may be selected as resin binders for the charge transport molecules those components as illustrated in U.S. Pat. No. 3,121,006 including polycarbonates, polyesters, epoxy resins, polyvinylcarbazole; and also wherein for the preparation of the charge transport layer with a polycarbonate there is selected methylene chloride as a solvent.

Although imaging members with various charge transport layers, especially hole transport layers materials with hole transport molecules including aryl amines dispersed in resinous binders, such as polycarbonates have been disclosed in the prior art, and are suitable for their intended purposes, a need remains for improved imaging members, particularly layered members, with chemically and mechanically robust transport layers, especially when the BCR is used as a charging device. Further, there continues to be a need for layered imaging members wherein the layers are sufficiently adhered to one another to allow the continuous use of such members in repetitive imaging systems. Also, there continues a need for improved layered imaging members comprised of hole transport layers wherein the problems of transport molecule crystallization, bleeding and leaching are avoided or minimized. Furthermore, there is a need for imaging members which can be fabricated from nontoxic solvents, and wherein the resulting imaging members are inert to the users thereof. A further need resides in the provision of photoconductive imaging members with desirable mechanical characteristics, and excellent photoinduced discharge core characteristics. These and other needs may be accomplished, it is believed, in embodiments of the present invention.

Another need resides in the provision of imaging members containing charge transport layers with improved xerographic electrical performance including higher charge acceptance, lower dark decay, increased charge generation efficiency, reduced residual charge and/or reduced erase energy, improved long-term cycling performance, and less variability in performance with respect to environmental changes in temperature and relative humidity. There is also a need for imaging members with enhanced photosensitivity in the red region of the light spectrum, enabling the resulting imaging members thereof to be selected for imaging with red diodes and gas lasers. Furthermore, there is a need for members with spectral response in the green and blue regions of the spectrum to enable imaging by newly emerging blue and green electronic imaging light sources. A further need is the provision of photoconductive imaging members whereas the transport layer binders selected provide excellent xerographic and mechanical performance characteristics, and which binders are readily accessible synthetically. These and other needs may be accomplished, it is believed, in embodiments of the present invention.

SUMMARY OF THE INVENTION

Examples of features of the present invention include:

It is a feature of the present invention to provide photoconductive imaging members.

It is another feature of the present invention to provide imaging members containing novel charge transport binders.

It is another feature of the present invention to provide photoconductive imaging members with photosensitivity in both the visible and infrared wavelength regions of light spectrum, such as from about 400 to about 900 nanometers.

Still, another feature of the present invention relates to the provision of novel transport layer binders, and more specifically, poly(imide-carbonate) binders.

Aspects of the present invention relate to a photoconductive imaging member comprised of a photogenerating layer and a charge transport layer, and wherein the charge transport layer contains a poly(imide-carbonate) resin binder of (I) or (II)

(I)

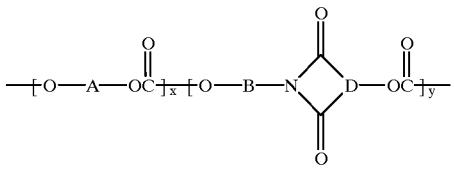

(II)

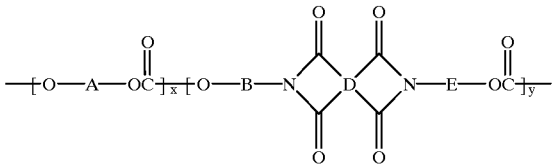

wherein A, B and E are divalent linkages; D is a trivalent linkage in (I) and a tetravalent linkage in (II); and x and y represent mole fractions wherein the sum of x+y is equal to 1; a photoconductive imaging member wherein A, B and E are independently selected from the group consisting of alkylene, arylene, diarylene, alkylenearyl, bis(arylene) alkane, and bis(arylene)sulfide; and D is a trivalent or tetravalent aromatic moiety; a photoconductive imaging member wherein the poly(imide-carbonate) binder is represented by (III)

(III)

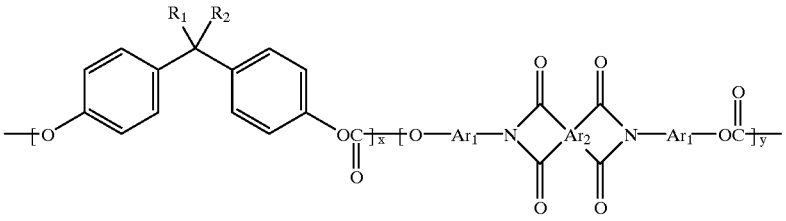

wherein $R_1$ and $R_2$ are independently selected from the group consisting of hydrogen, alkyl, substituted alkyl, aryl, and substituted aryl; $Ar_1$ is arylene, or substituted arylene; and $Ar_2$ is a tetravalent aromatic linkage; a photoconductive imaging member wherein $R_1$ and $R_2$ are alkyl containing from about 1 to about 10 carbon atoms; a photoconductive imaging member wherein for the poly(imide-carbonate) binder $Ar_1$ is arylene containing from about 7 to about 20 carbon atoms; a photoconductive imaging member wherein for the binder formula $Ar_1$ is selected from the group consisting of the following

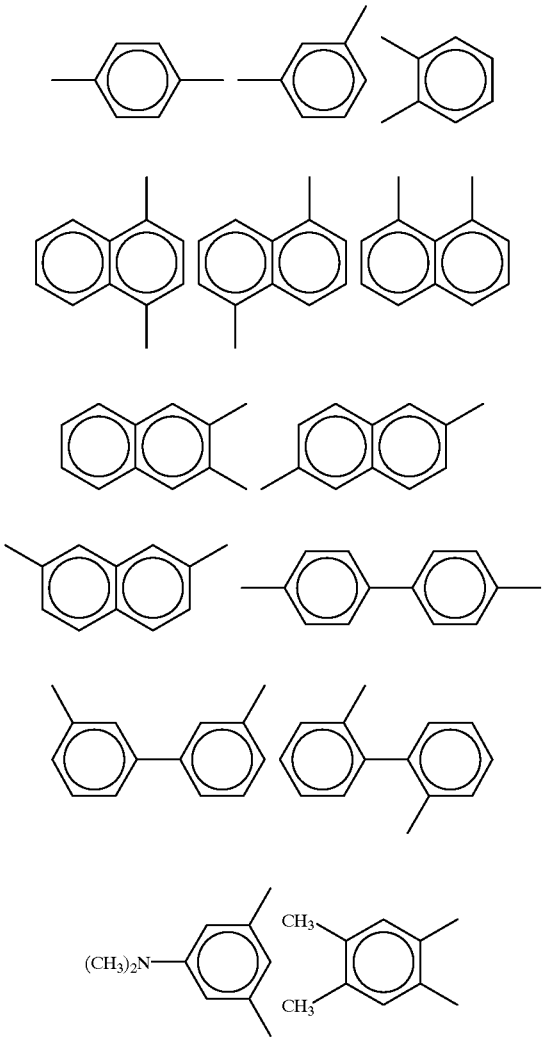

-continued

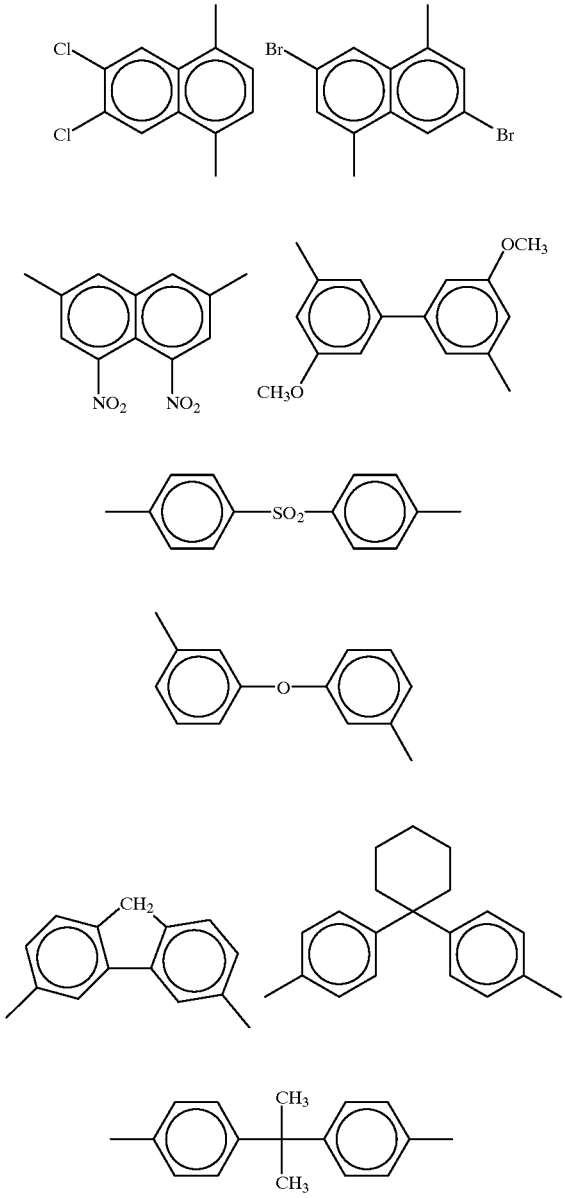

a photoconductive imaging member wherein the poly (imide-carbonate) is selected from the group consisting of (IIIa) through (IIIj)

(IIIa)
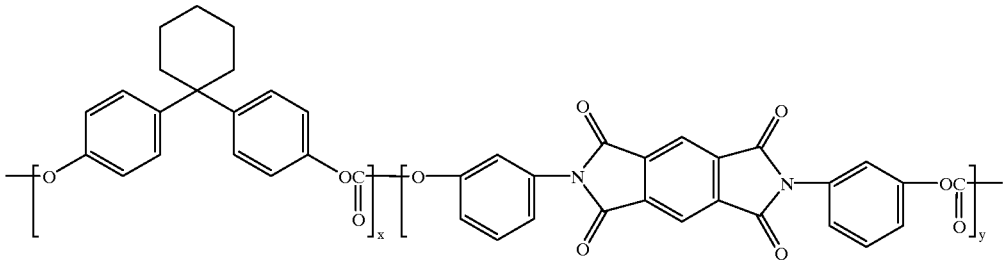
(IIIb)
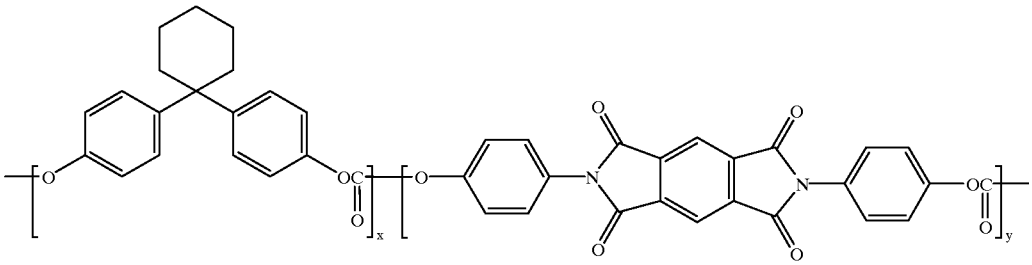
(IIIc)
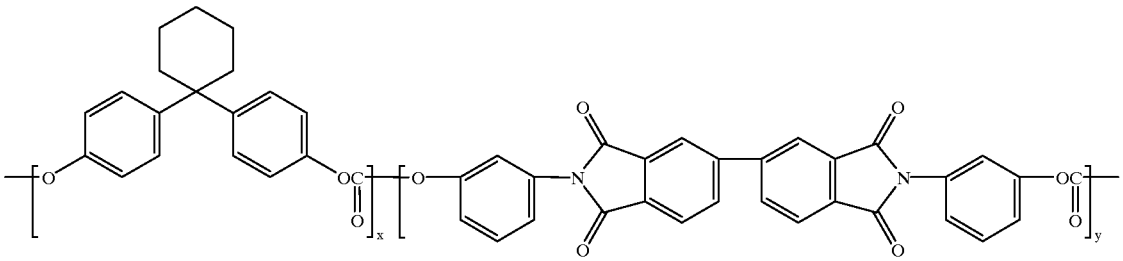
(IIId)
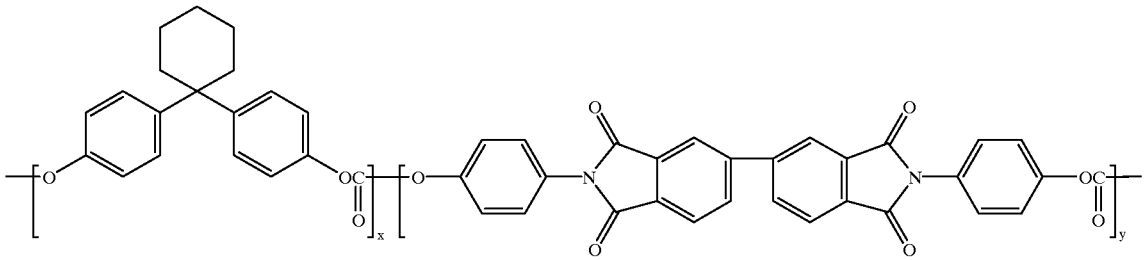
(IIIe)
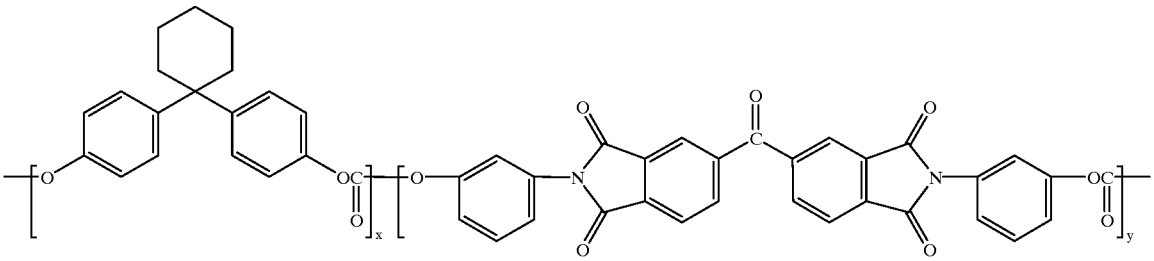

-continued
(IIIf)
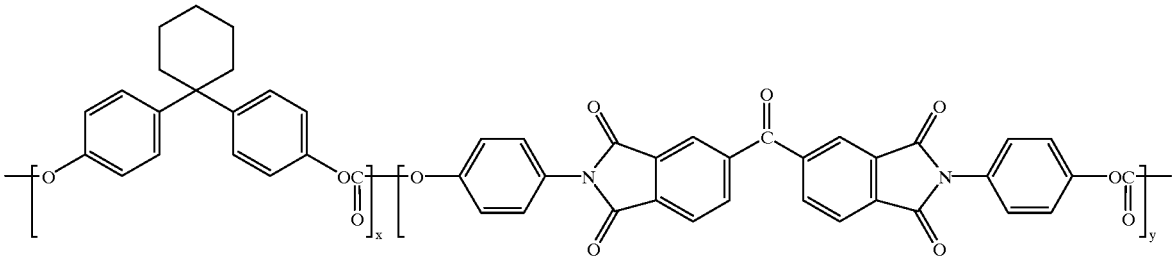
(IIIg)
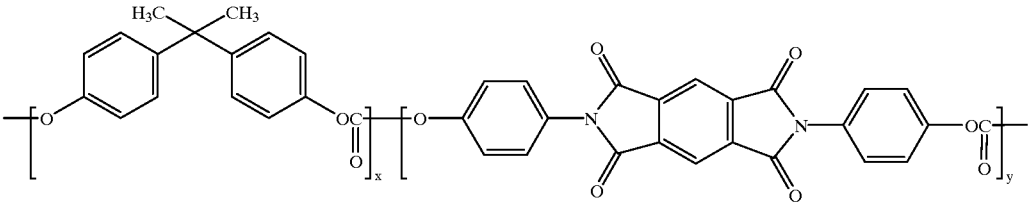
(IIIh)
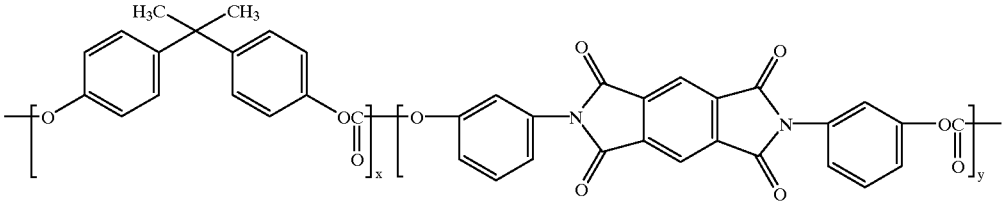
(IIIi)
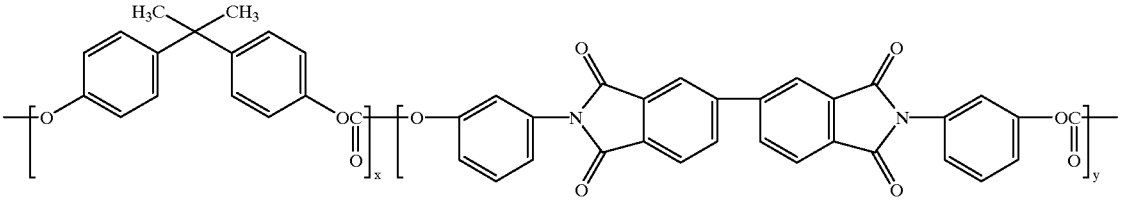
(IIIj)
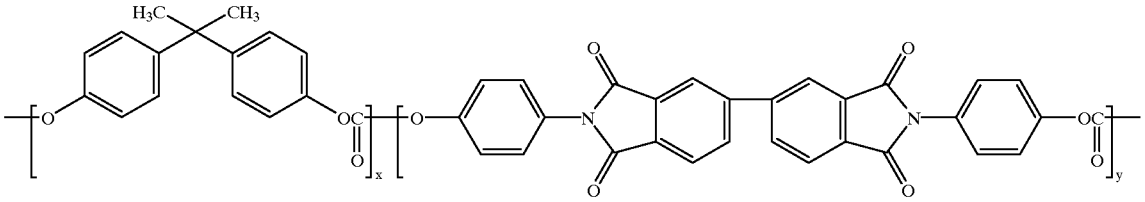
a photoconductive imaging member wherein the resin binder represented by (IIIa), (IIIb), (IIIc), (IIId), or (IIIe) is selected
(IIIa)
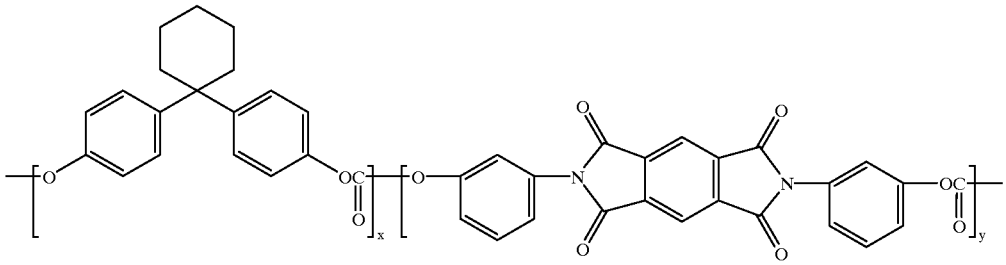

-continued
(IIIb)
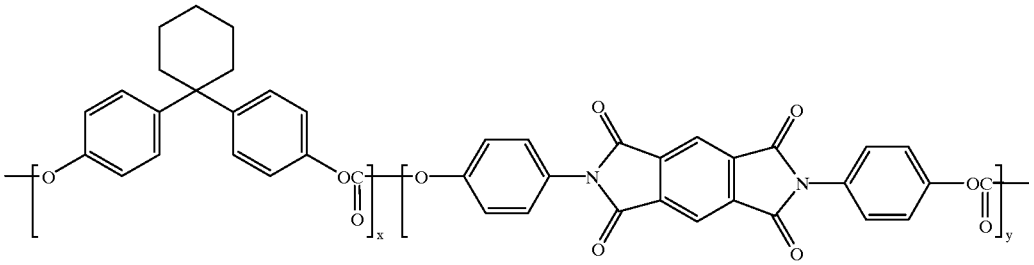
(IIIc)
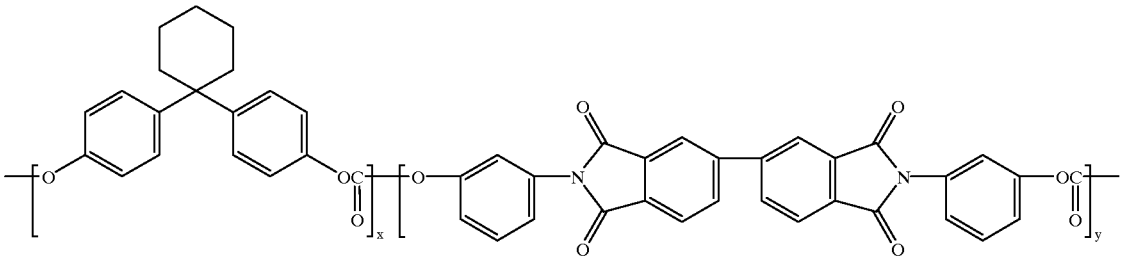
(IIId)
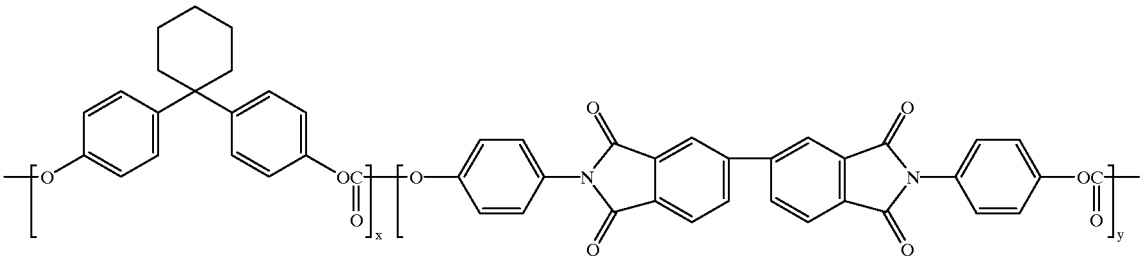
(IIIe)
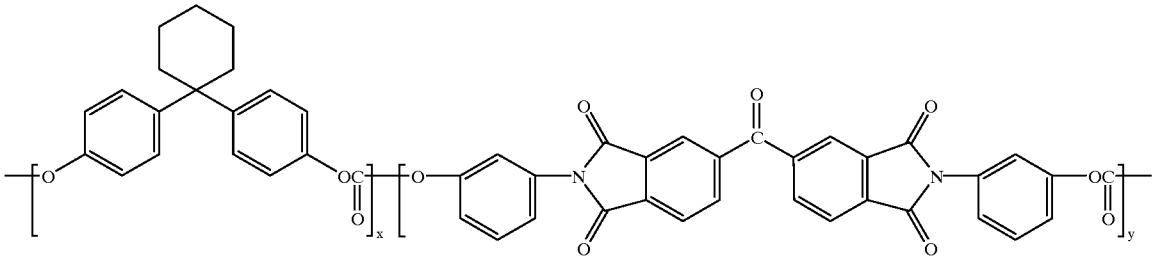
a photoconductive imaging member wherein the binder (IIIf), (IIIg), (IIIh), (IIIi), (IIIj) or mixtures thereof are selected
(IIIf)
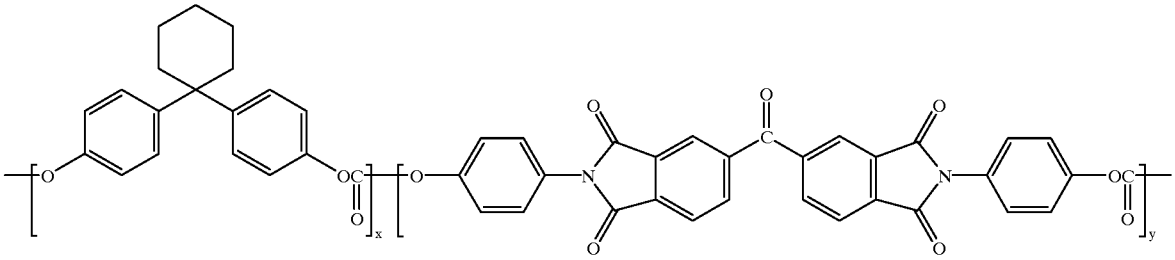

-continued (IIIg)

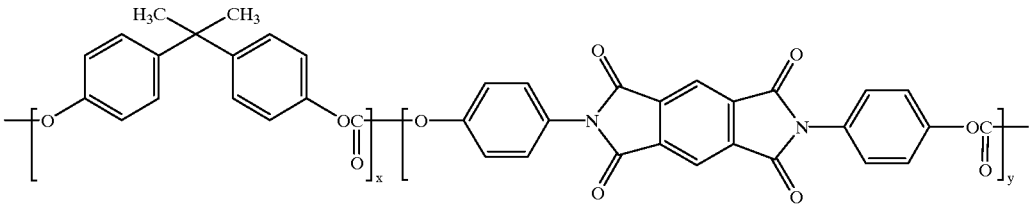

(IIIh)

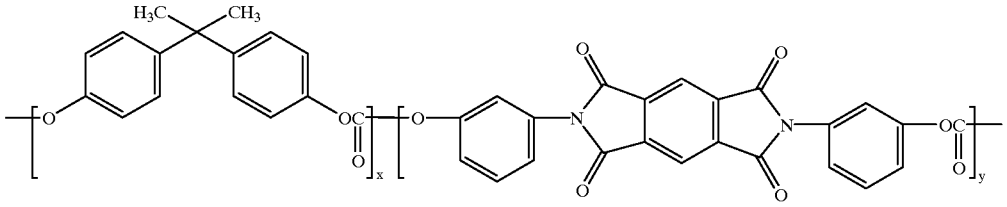

(IIIi)

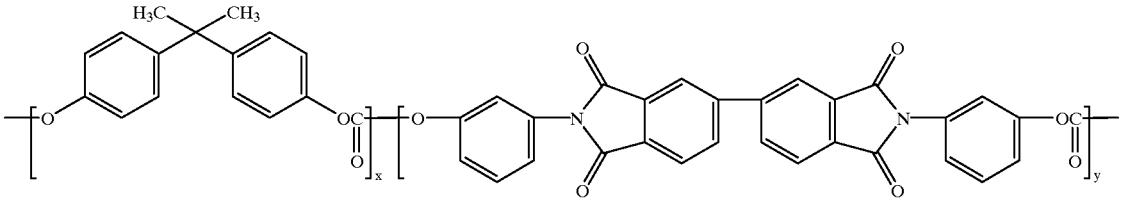

(IIIj)

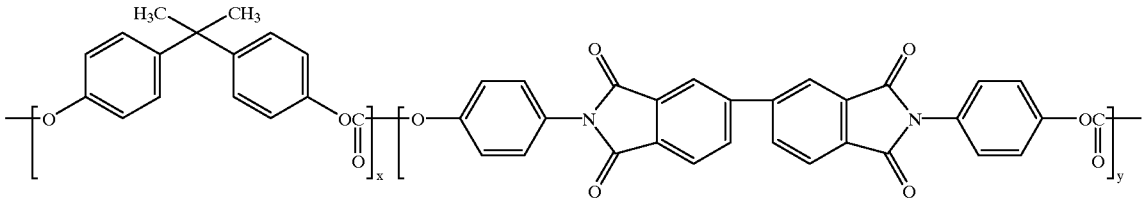

a photoconductive imaging member wherein the poly (imide-carbonate) is present in an amount of from about 25 to about 70 weight percent, and the total amount of said poly(imide-carbamate) and the charge transport component equals about 100 percent; a photoconductive imaging member wherein the poly(imide-carbonate) is present in an amount of from about 40 to about 55 weight percent, and the total amount of the poly(imide-carbamate) and the charge transport molecules equals about 100 percent; a photoconductive imaging member wherein the poly(imide-carbonate) is of the formula (the substituents, such as X, are throughout as illustrated herein)

(IIIa)

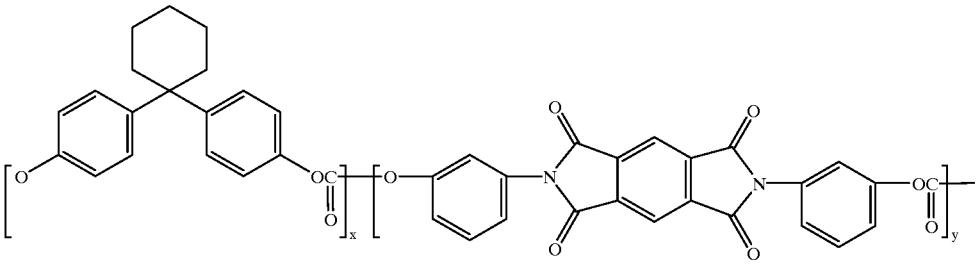

a photoconductive imaging member wherein the poly (imide-carbonate) possesses a weight average molecular weight, $M_w$, of from about 30,000 to about 500,000; a photoconductive imaging member wherein the poly(imide-carbonate) optionally possesses a number average molecular weight, $M_n$, of from about 5,000 to about 100,000; a photoconductive imaging member wherein aryl amine hole transport molecules are dispersed in a poly(imide-carbonate) of (IIIa) through (IIIj) of the formulas (IIIa)

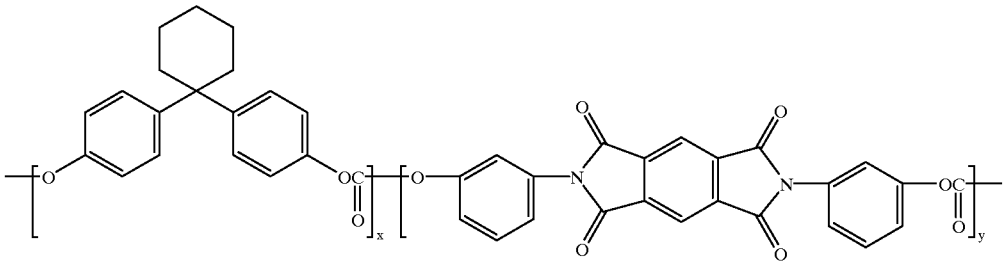

(IIIb)

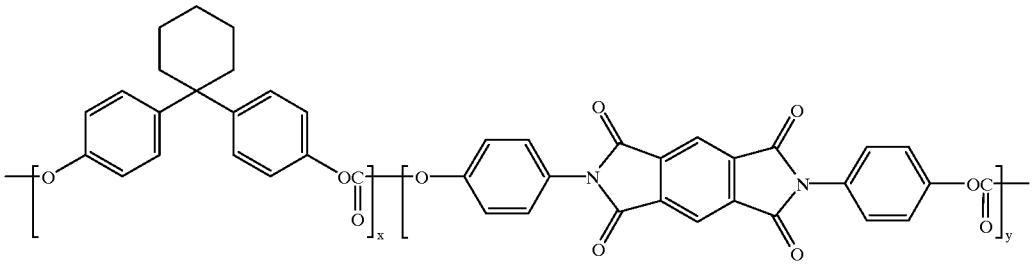

(IIIc)

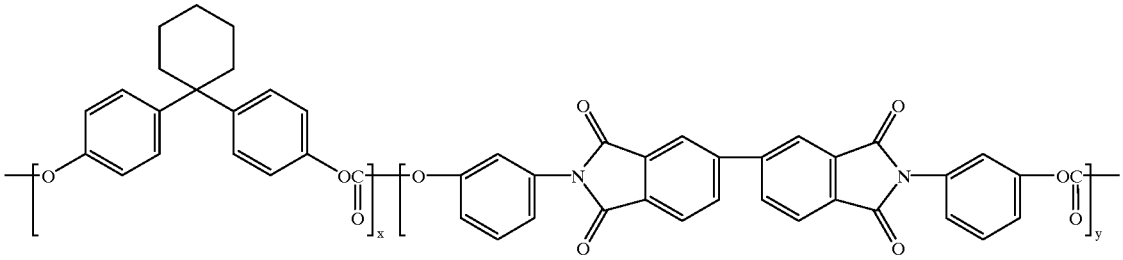

(IIId)

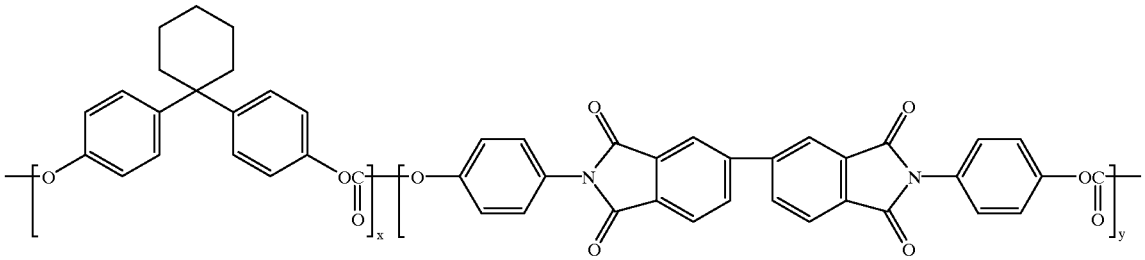

(IIIe)

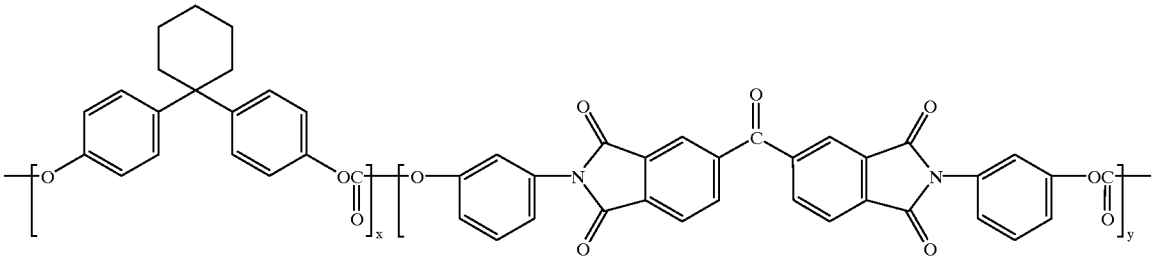

-continued (IIIf)

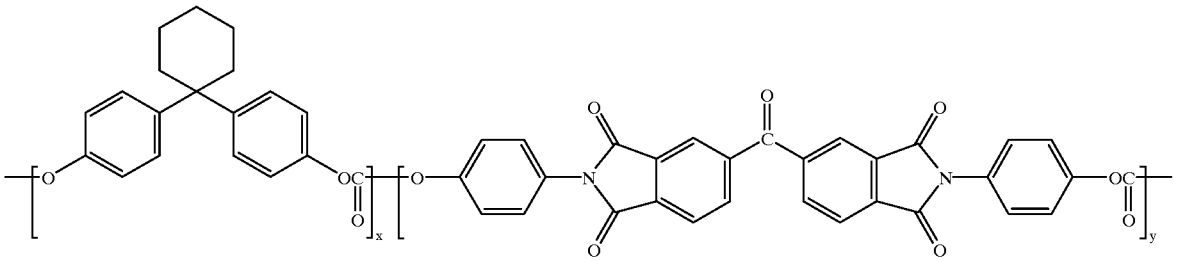

(IIIg)

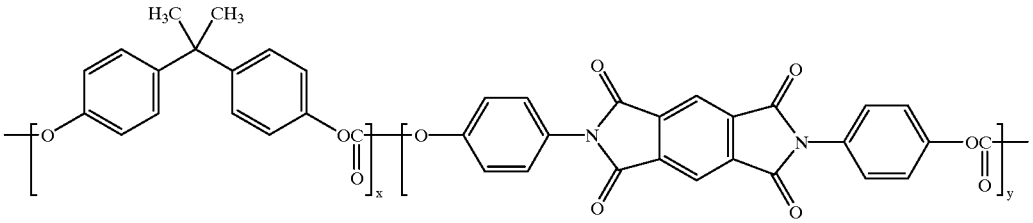

(IIIh)

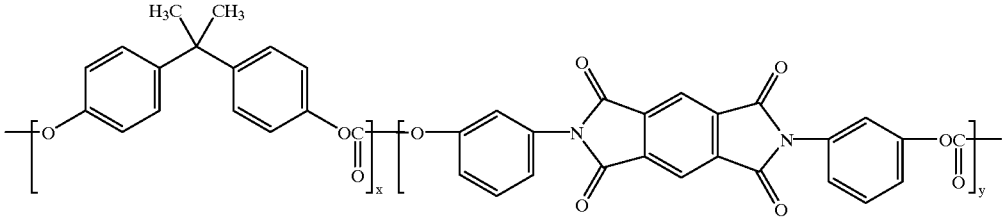

(IIIi)

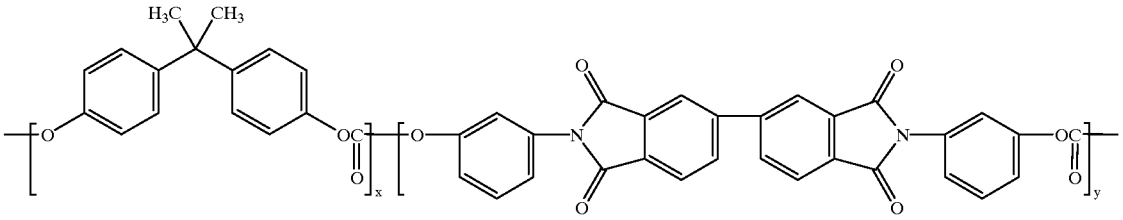

(IIIj)

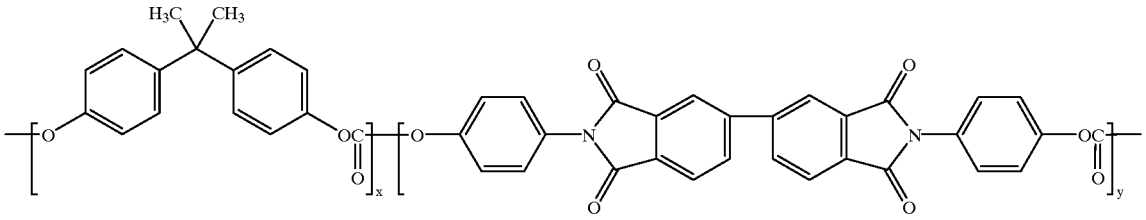

a photoconductive imaging member wherein the photogenerating layer is comprised of photogenerating pigments of metal phthalocyanines, metal free phthalocyanines, perylenes, titanyl phthalocyanines, selenium, or hydroxygallium phthalocyanines; a photoconductive imaging member wherein the photogenerating pigments are dispersed in a resin binder; a photoconductive imaging member wherein the binder is a poly(imide-polycarbonate); a photoconductive imaging member wherein the photogenerating pigments are comprised of a perylene of the formula

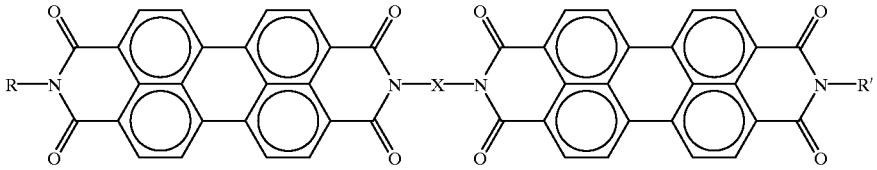

wherein each R and R' is independently selected from the group consisting of hydrogen, alkyl, substituted alkyl, aryl, substituted aryl, and X represents a bridging linkage; a photoconductive imaging member wherein X is alkylene, substituted alkylene, arylene, or substituted arylene; a photoconductive imaging member wherein the perylene X is selected from the group consisting of the following

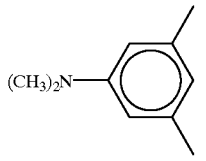

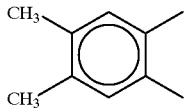

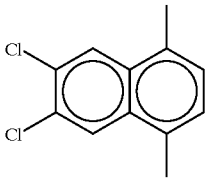

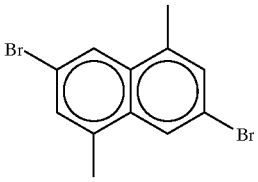

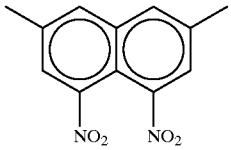

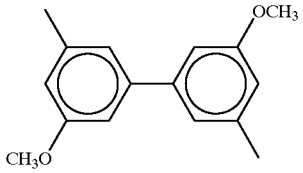

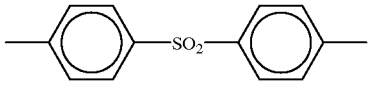

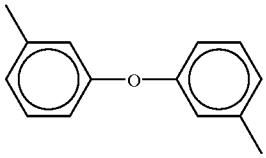

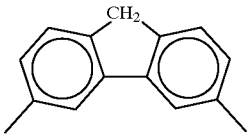

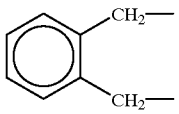

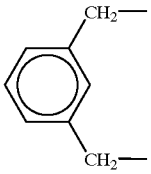

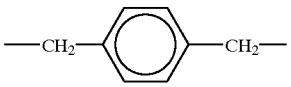

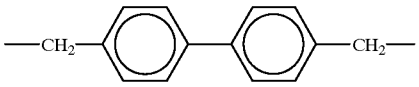

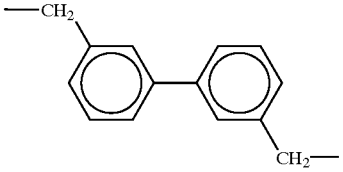

-continued

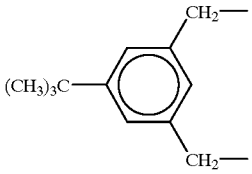

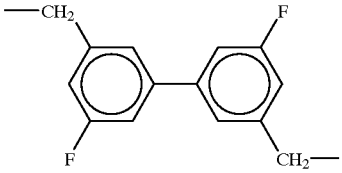

$—CH_2CH_2—$ $—CH_2CH_2CH_2—$ $—CH_2CH(CH_3)CH_2—$ $—CH_2C(CH_3)_2CH_2—$ $—CH_2CH_2CH_2CH_2—$ $—CH_2CH(CH_3)CH(CH_3)CH_2—$ $—CH_2CH_2CH_2CH_2CH_2—$ $—CH_2CH_2CH(CH_3)CH_2CH_2—$ $—CH_2CH_2CH_2CH_2CH_2CH_2—$ $—CH_2CH_2CH_2CH_2CH_2CH_2CH_2—$ $—CH_2CH(OH)CH_2—$ $—CH_2CH(OCH_3)CH_2—$ $—CH_2CH_2CH[N(CH_3)_2]CH_2CH_2—$ and

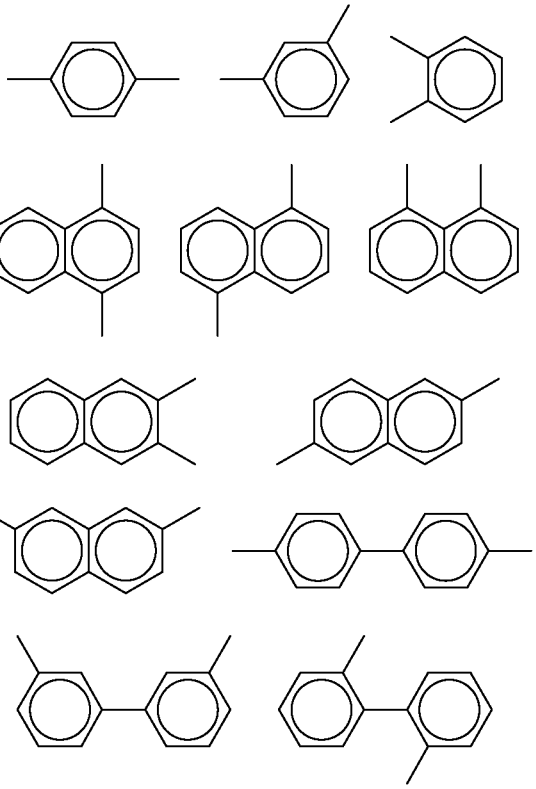

a photoconductive imaging member wherein the photogenerating layer is comprised of pigments of a perylene or mixtures thereof of the formula

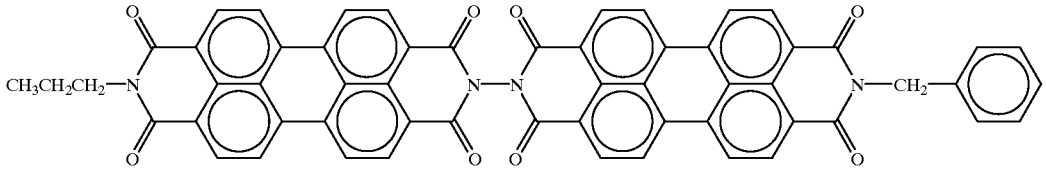

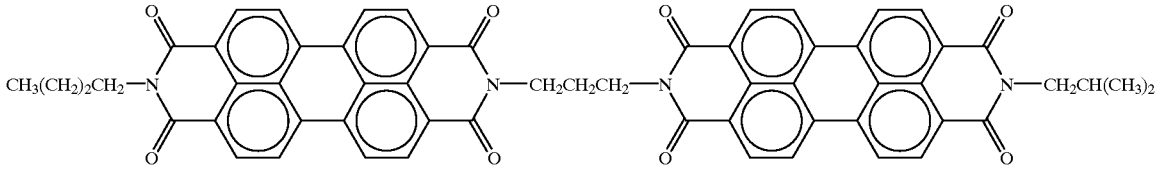

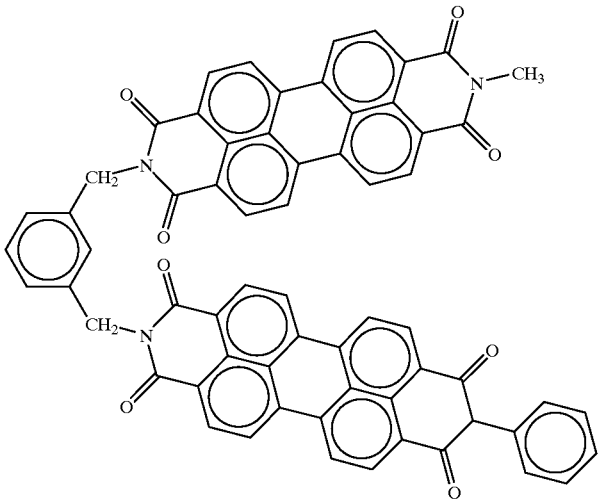

a photoconductive imaging member containing a supporting substrate in contact with the photogenerating layer, or containing a supporting substrate in contact with the charge transport layer; a photoconductive imaging member wherein the supporting substrate is a metal, a conductive polymer, or an insulating polymer, each with a thickness of from about 30 microns to about 300 microns optionally overcoated with an electrically conductive layer with an optional thickness of from about 0.01 micron to about 1 micron; a photoconductive imaging member wherein there is further optionally included an overcoating polymer top layer on the member; a photoconductive imaging member wherein the photogenerator layer component is dispersed in a resinous binder in an amount of from about 5 percent to about 95 percent by weight, and optionally wherein the resinous binder is a polyester, a polyvinylcarbazole, a polyvinylbutyral, a polycarbonate, a polyether carbonate, an aryl amine polymer, a styrene copolymer, or a phenoxy resin; a photoconductive imaging member wherein the charge transport layer is comprised of aryl amines optionally dispersed in a poly(imide-carbonate) binder; a photoconductive imaging member wherein the charge transport layer is comprised of molecules of the formula dispersed in a poly(imide-carbonate) binder

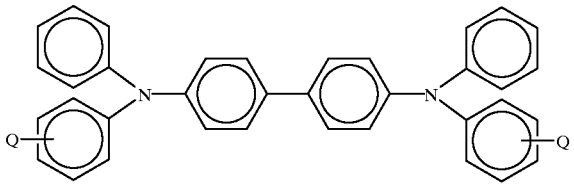

wherein Q is independently selected from halide or alkyl; a photoconductive imaging member wherein the charge transport layer is comprised of the aryl amine molecules in an amount of from about 20 to about 60 percent dispersed in said poly(imide-carbonate); a photoconductive imaging member wherein the photogenerating layer is of a thickness of from about 0.2 to about 10 microns, wherein the charge transport layer is of a thickness of from about 10 to about 100 microns, and wherein there is included a supporting substrate overcoated with a polymeric adhesive layer of a thickness of from about 0.01 to about 1 micron; a photoconductive imaging method comprising the formation of a latent image on the photoconductive imaging member of the present invention, developing the image with a toner composition comprised of resin and colorant, transferring the image to a substrate, and optionally fixing the image thereto; poly(imide-carbonates) of the formula (III)

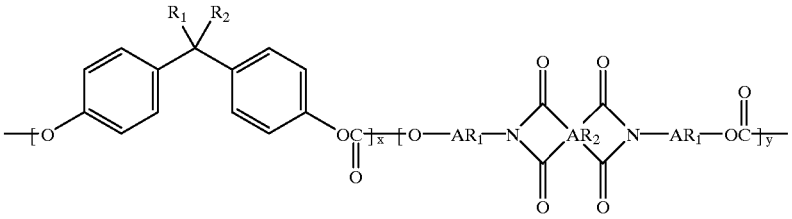

wherein $R_1$ and $R_2$ are independently selected from the group consisting of hydrogen, alkyl, substituted alkyl, aryl, and substituted aryl; $Ar_1$ is arylene including substituted arylenes; $Ar_2$ is a tetravalent aromatic linkage, and x and y are mole fractions of the repeating units such that x+y is equal to 1; the poly(imide-polycarbonates) represented by Formulas (IIIa) through (IIIj)

(IIIa)

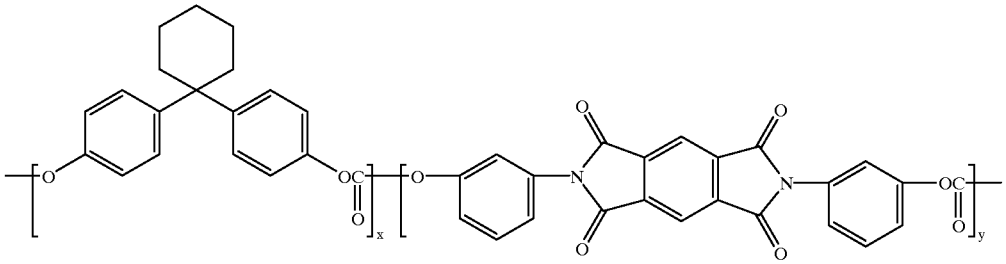

(IIIb)

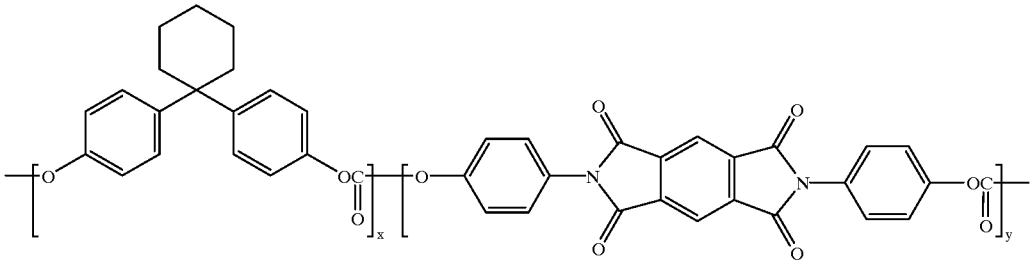

(IIIc)

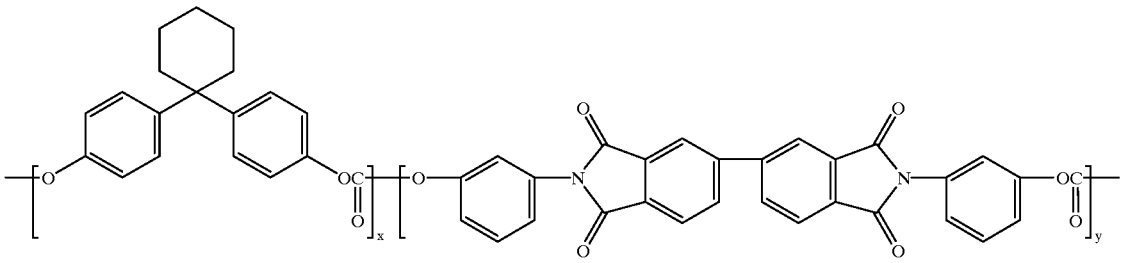

(IIId)

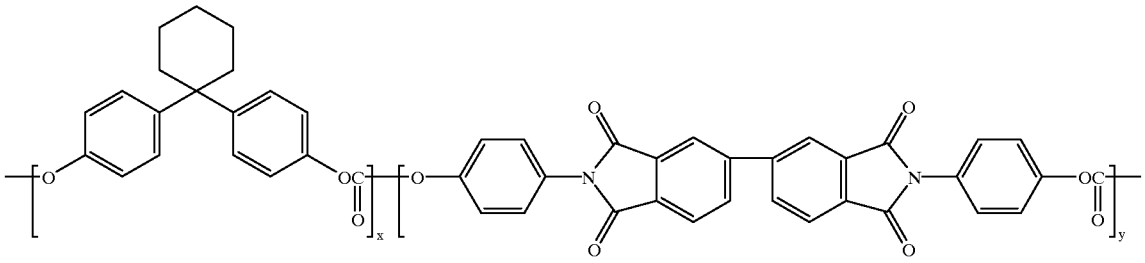

-continued
(IIIe)
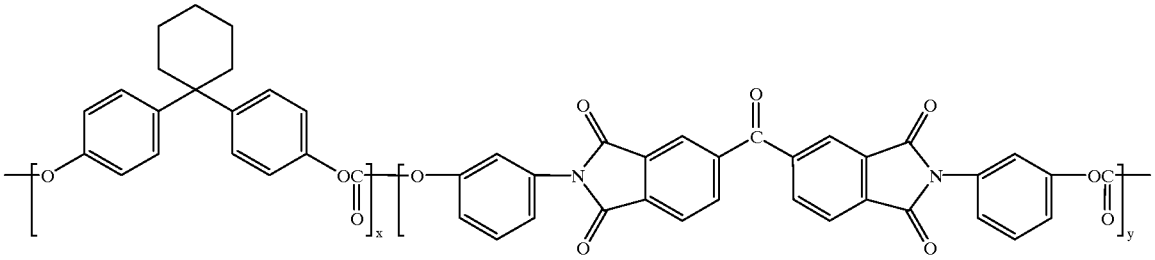
(IIIf)
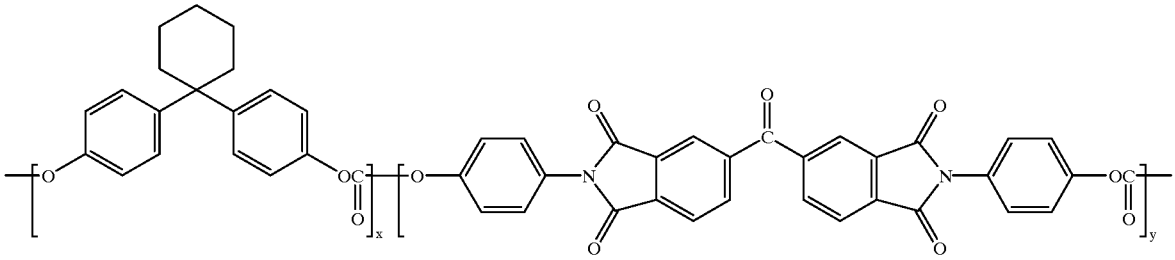
(IIIg)
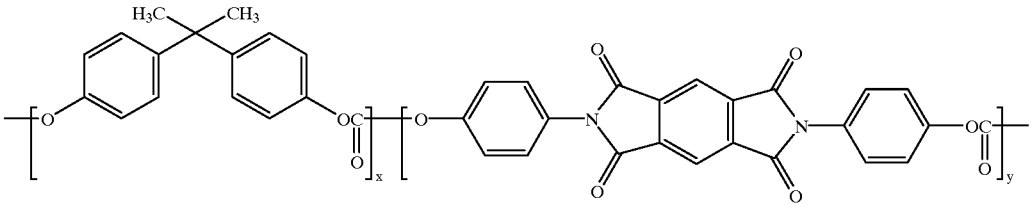
(IIIh)
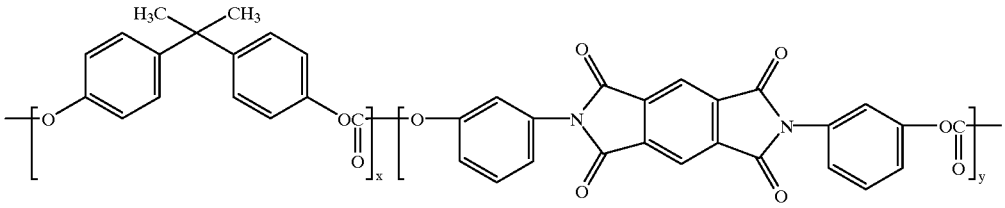
(IIIi)
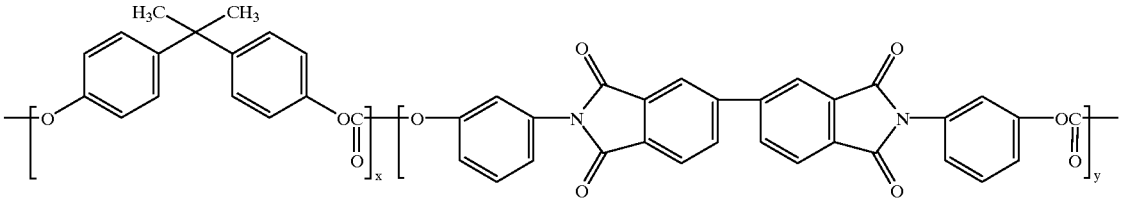
(IIIj)
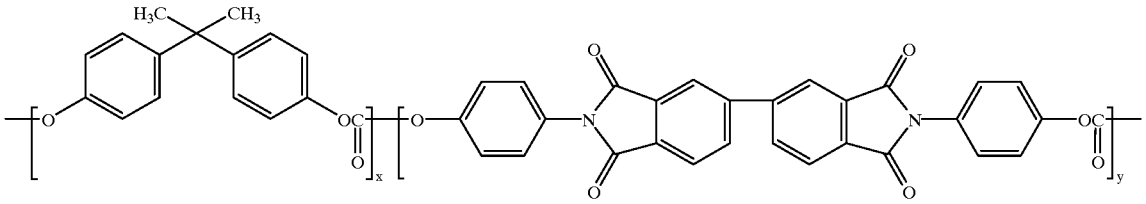

a polyimide-carbonate as illustrated herein wherein $Ar_2$ is monocyclic linkage derived from pyromellitic acid, a bicyclic linkage derived from biaryl-, benzophenone-, diarylsulfide, or diaryl sulfone tetracarboxylic acids; a poly (imide carbonate) of the Formulas (I) or (II)

(I)

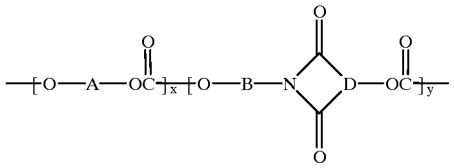

(II)

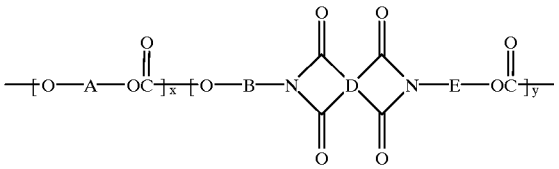

wherein A, B and E are divalent linkages; D is a trivalent or tetravalent linkage; and x and y represent the mole fractions wherein the sum of x+y is equal to 1; a poly(imide carbonate) of Formula (I)

(I)

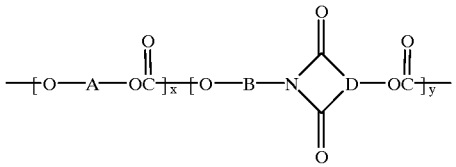

wherein A and B are divalent linkages or groups, D is a trivalent group or linkage, and x and y represent mole fractions wherein the sum of x+y is equal to 1; a poly(imide carbonate) of the Formula (II)

(II)

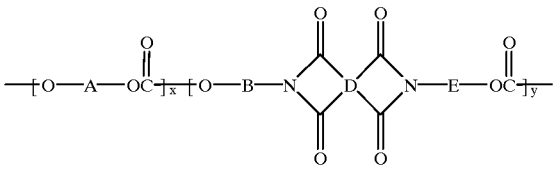

wherein A, B and E are divalent linkages, D is a tetravalent linkage, and x and y represent mole fraction numbers; a photoconductive imaging member wherein A, B and E alkylene contains from about 1 to about 26 carbon atoms, arylene contains from about 7 to about 30 carbon atoms, D is a trivalent linkage, x is from about 0.1 to about 0.99, and y is from about 0.1 to about 0.99, and wherein the sum of x+y is equal to 1; a photoconductive imaging member wherein for the poly(imide carbonate) alkylene contains from about 1 to about 26 carbon atoms, arylene contains from about 7 to about 30 carbon atoms, D is a tetravalent linkage, x is from about 0.1 to about 0.99, and y is from about 0.1 to about 0.99, and wherein the sum of x+y is equal to 1; a photoconductive imaging member wherein the novel poly(imide carbonate) is of the formula (I)

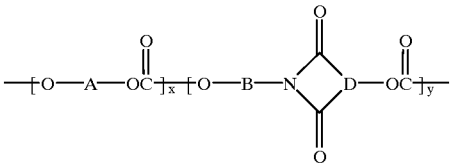

wherein D is a divalent linkage and other substituents are as illustrated herein; a photoconductive imaging member wherein the poly(imide carbonate) is of the Formula (II)

(II)

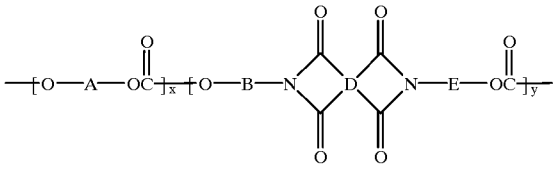

wherein x is from about 0.4 to about 0.6 and y is from about 0.6 to about 0.4 mol percent, and D is a tetravalent linkage; a photoconductive imaging member wherein a supporting substrate is present and the charge transport component is a hole transport; a photoconductive imaging member wherein a supporting substrate is present and said charge transport component is comprised of hole transports; photoconductive imaging members comprised of a charge transport layer in contact with a photogenerating layer, and wherein the charge transport components, such as charge transport molecules, are dispersed in a poly(imide-carbonate) binder; photoconductive imaging members comprised of a supporting substrate, a charge transport layer, and a photogenerator layer and wherein the charge transport components, such as charge transport molecules, are dispersed in a poly(imide-carbonate) binder; an imaging member wherein the supporting substrate is a metal, a conductive polymer, an insulating polymer, and the like, each with a thickness of from about 30 microns to about 300 microns optionally overcoated with an electrically conductive layer with an optional thickness of from about 0.01 micron to about 1 micron; an imaging member wherein there is further included an overcoating polymer top layer on the member; an imaging member wherein the photogenerator layer component is dispersed in a resinous binder in an amount of from about 5 percent to about 95 percent by weight; an imaging member wherein the photogenerator layer contains a resinous binder of a polyester, a polyvinylcarbazole, a polyvinylbutyral, a polycarbonate, a polyethercarbonate, an aryl amine, a styrene copolymer, or a phenoxy resin; an imaging member wherein the charge transport layer is comprised of aryl amines or aryl amine polymers; an imaging member wherein the charge transport layer is comprised of an amine; an imaging member wherein the charge transport layer is comprised of hole transport components comprised of molecules of the formula

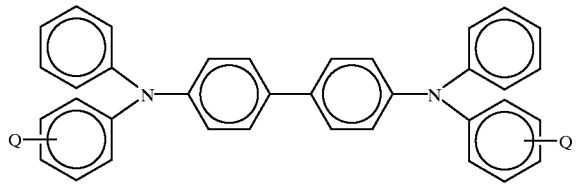

wherein Q is independently halo or alkyl; an imaging member wherein the charge transport layer is comprised of the aryl amine molecules dispersed in a poly(imide-carbonate) binder, which binder is selected, for example, in an amount of from about 20 to about 65 percent; an imaging member wherein the photogenerating layer is of a thickness of from about 0.1 to about 10 microns, wherein the charge transport layer is of a thickness of from about 10 to about 100 microns, and wherein the supporting substrate is overcoated with a polymeric adhesive layer of a thickness of from about 0.01 to about 2 microns; an imaging method comprising the formation of a latent image on the photoconductive imaging member, developing the image with a toner composition comprised of resin and colorant, transferring the image to a substrate, and optionally fixing the image thereto; imaging members comprised, for example, in the sequence order indicated, a conductive substrate, a photogenerating layer dispersed in a resinous binder composition, and a charge transport layer, which comprises hole transporting molecules dispersed in a poly(imide-carbonate); and photoconductive imaging members comprised of substrate, a hole transport layer comprising a hole transport composition, such as an aryl amine, dispersed in a poly(imide-carbonate), a photogenerating layer thereover, and as a top protective polymer layer.

In embodiments of the present invention, as the binder for the charge transport layer and optionally for the photogenerating layer, there is selected a poly(imide-carbonate) represented by the general formula (I) or (II):

(I)

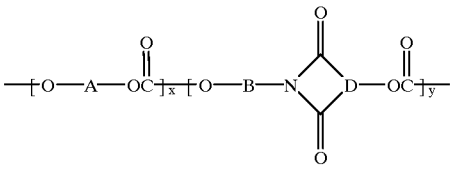

-continued (II)

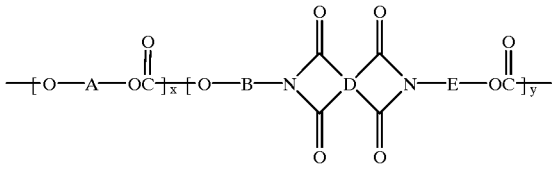

wherein A, B, and E are divalent linkages independently selected, for example, from the group consisting of alkylene, arylene, biarylene, alkylenearyl, and the like; D is a trivalent linkage in (I) and a tetravalent linkage in (II), preferably selected from the group consisting of arylene, cyclic alkylene and the like; x and y are the number of, and preferably the mole fractions of the repeating units such that x+y is preferably equal to 1.

Alkylene can contain, for example, from 1 to about 25 carbon atoms, such as ethylene, propylene, butylene, pentylene, octylene and the like; arylene can contain from about 7 to about 36 carbon atoms, such as phenylene, anthylene, and the like; alkyl can contain, for example, from 1 to about 30 carbon atoms, such as methyl, ethyl, propyl, butyl, pentyl and the like, reference especially $R_1$ and $R_2$ hereinafter; and wherein each of the substituents or groups contain substituents, or be substituted with alkyl, aryl, and the like. In embodiments, the poly(imide-carbonates) selected as the transport layer binders of the imaging members of the present invention are represented by the general Formula (III):

(III)

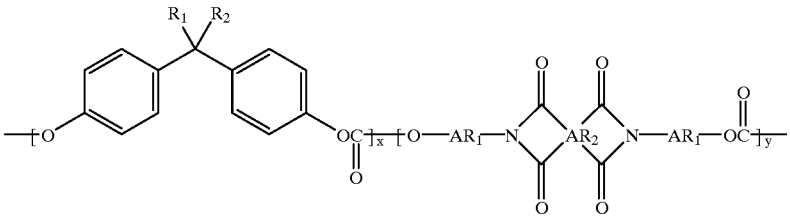

wherein x and y are the number of repeating segments, such as the molar fractions of the repeating monomer units, such that the sum of x+y equal to 1; $R_1$ and $R_2$ are, for example, independently selected from the group consisting of hydrogen, alkyl, substituted alkyl, aryl, substituted aryl, and the like, wherein alkyl can be substituted with, for example, halogen such as fluoro, chloro and bromo, alkoxy, and aryloxy, and aryl can contain substituents such as alkyl including methyl, ethyl, propyl, butyl, pentyl, hexyl, heptyl, octyl, nonyl, decyl, and the like; $Ar_1$ is arylene, substituted arylene, such as alkyl substituents including methyl, ethyl, propyl, butyl, pentyl, hexyl, heptyl, octyl, nonyl, decyl, and the like; and $Ar_2$ is preferably an aromatic linkage, examples of $Ar_2$ being monocyclic linkages such as those derived from pyromellitic acid; bicyclic linkages such as those derived from the biphenyl-, benzophenone-, diphenyl sulfide and diphenyl sulfone tetracarboxylic acids; linkages derived from the 2,2-bis[4-(dicarbonsyphenoxy)phenyl] propanetetracarbonxylic acids, especially the 3,4-dicarboxyphenoxylic acid; and other linkages to enable four bonds to the two rings illustrated; and a photoconductive imaging member wherein x ranges from about 0.50 to about 0.99; and y ranges from about 0.01 to about 0.50.

Illustrative examples of poly(imide-carbonates) are represented by Formulas (IIIa) through (IIIj) wherein x and y are as indicated herein (IIIa)

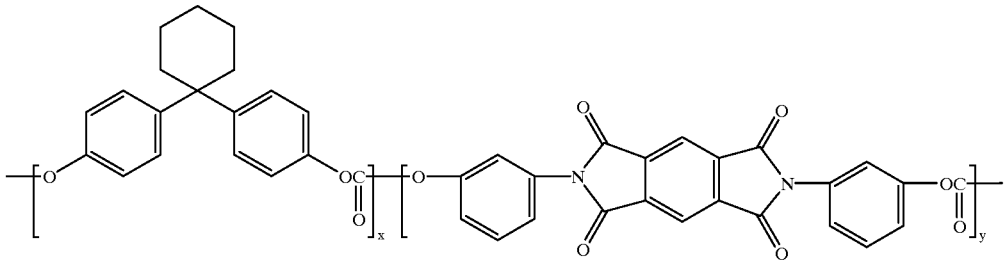

(IIIb)

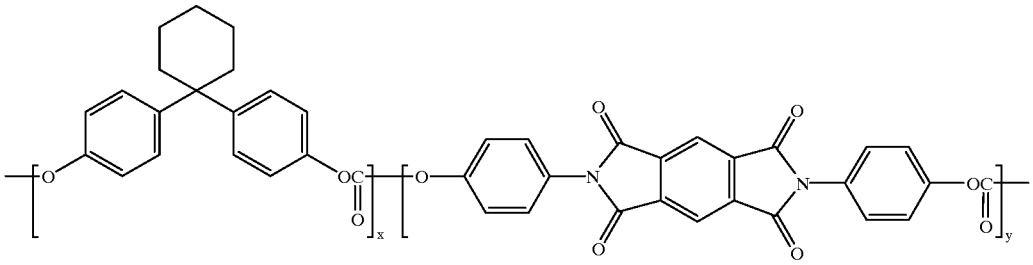

(IIIc)

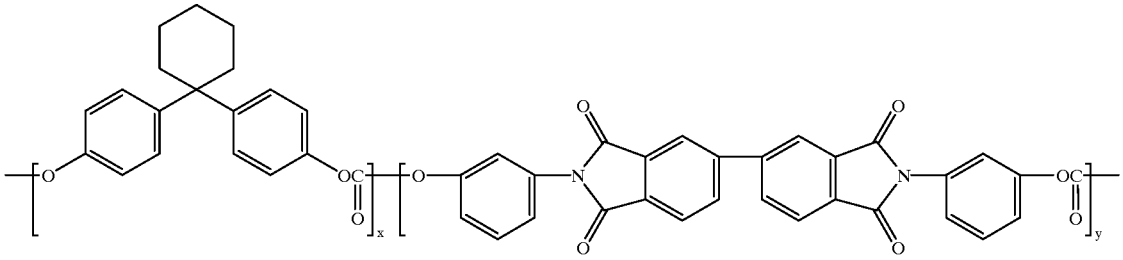

(IIId)

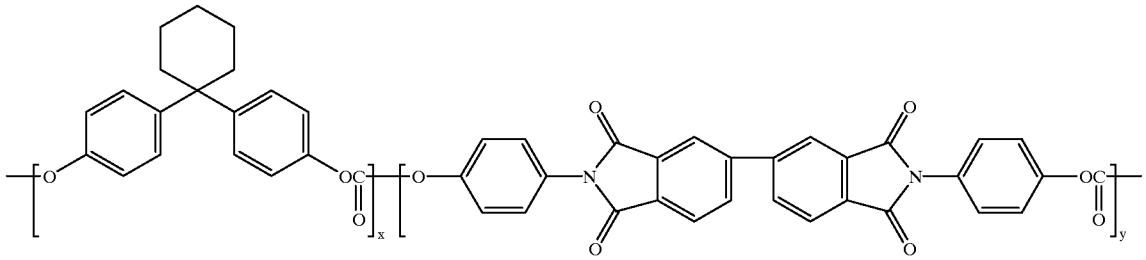

(IIIe)

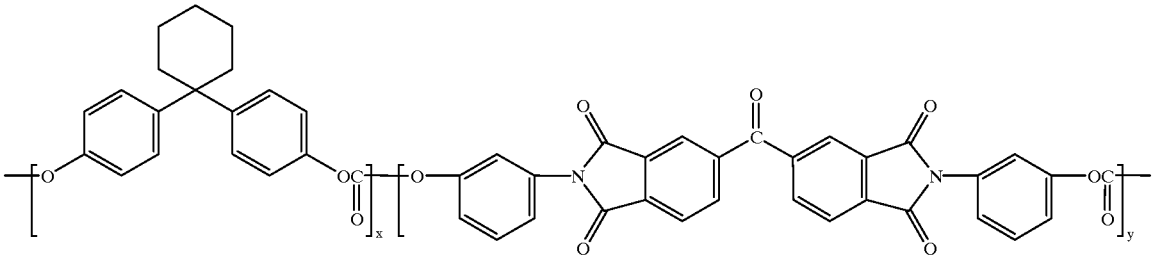

-continued (IIIf)

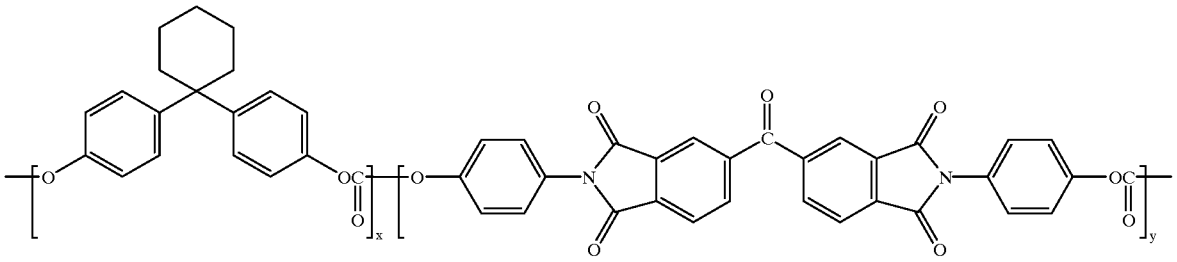

(IIIg)

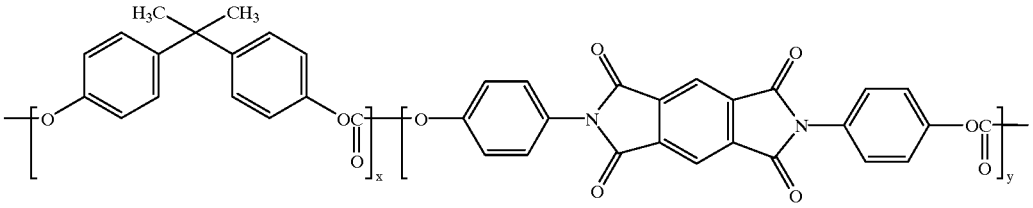

(IIIh)

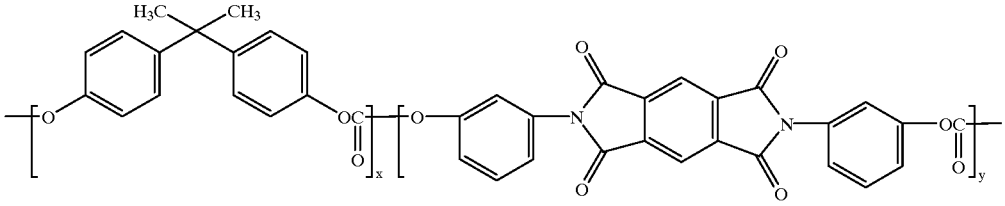

(IIIi)

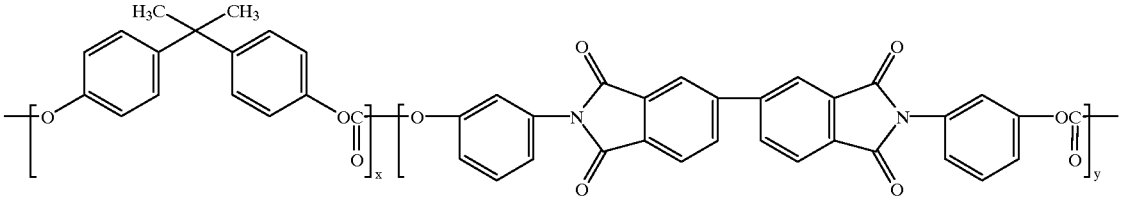

(IIIj)

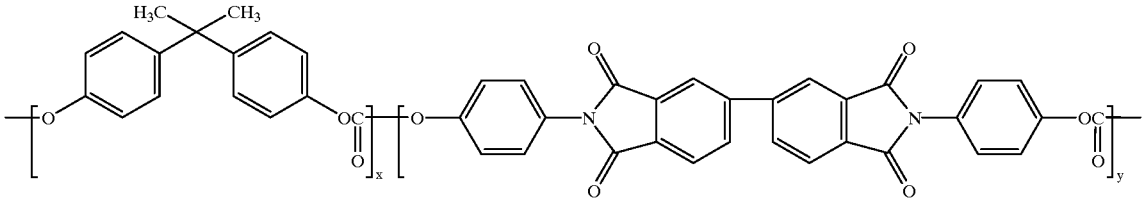

The weight average molecular weight, $M_w$, of the poly (imide-carbonate) (IIIa to IIIj) ranges, for example, from about 30,000 to about 500,000; preferably from about 50,000 to about 150,000; the preferred number average molecular weight, $M_n$, of the poly(imide-carbonate) (III) ranges from about 5,000 to about 100,000; and preferably from about 20,000 to about 70,000.

Poly(imide-carbonate) (III) of the present invention can be prepared by modified known interfacial phosgenation, reference U.S. Pat. No. 4,393,190, the disclosure of which is totally incorporated herein by reference, and more specifically, by interfacial phosgenation methods according to Scheme 1. Specifically, the poly(imide carbonate) can be prepared by the following method. A mixture of a biphenol monomer, such as 4,4-cyclohexylidenebisphenol with an aqueous inorganic base solution, such as, sodium hydroxide, and an organic solvent, such as dichloromethane, in the presence of a suitable amount, such as about 0.5 to about 3 weight percent, of a phase transfer catalyst like benzyltriethylammonium chloride was stirred at room temperature (25° C.). To the mixture was added triphosgene dichloromethane solution and a bis(imidephenol) monomer. A second catalyst, such as triethylamine, tributyl amine or the like, can be added to accelerate the reaction. An excess of inorganic base solution may be selected to increase the molecular weight at the end of a reaction. The interfacial phosgenation is generally accomplished at temperature of from about 0° C. to about 100° C., and preferably from room temperature (25° C.) to about 50° C. The reaction time is generally from about 10 minutes to about 5 hours depending, for example, on the molecular weight of the polymer desired. The polymeric product obtained can then be purified by dissolving it in an organic solvent, such as dichloromethane or tetrahydrofuran (THF), and then precipitating in methanol to provide a pure, for example from 90 to 99.5 percent pure, polymer which are suitable as charge transporting binders. The products and structures thereof can be confirmed by NMR and IR spectroscopy. The number and weight average molecular weights of the polymer and the $M_w/M_n$ can be obtained by a Waters Gel Permeation Chromatograph employing four ULTRASTYRAGEL® columns with pore sizes of 100, 500, 500, and 104 Angstroms and using THF (tetrahydrofuran) as a solvent.

Scheme 1

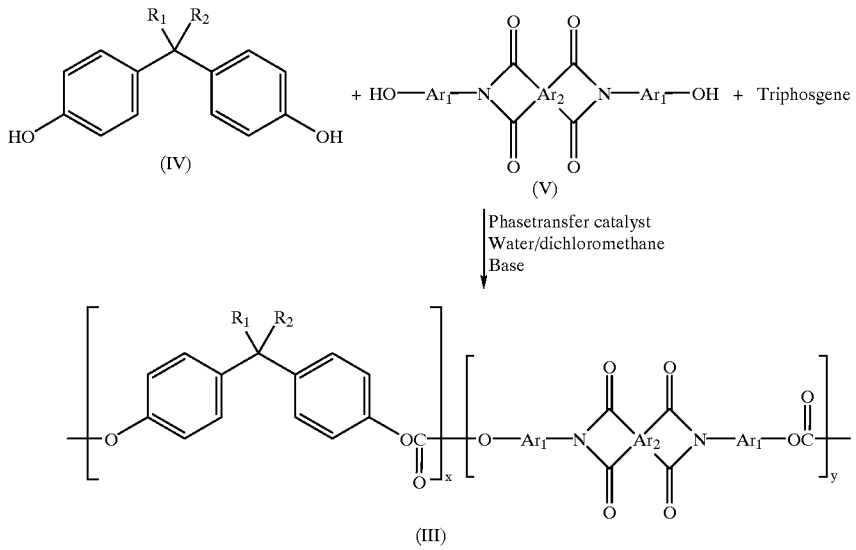

wherein $R_1$, $R_2$, $Ar_2$ and $Ar_2$, x and y are as illustrated herein.

Illustrative examples of bisphenol (IV) selected for the preparation of poly(imide-carbonate) (III) include bisphenol, bis(hydroxyphenyl)methane, bis(hydroxyphenyl) dimethylmethane, bis(hydroxyphenyl)cyclohexane, and the like; illustrative examples of monomer (V) include in the alternative:

(Va)

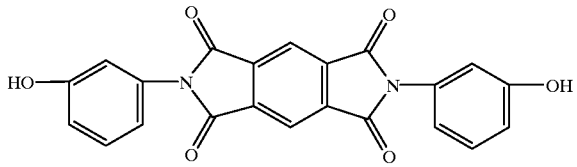

(Vb)

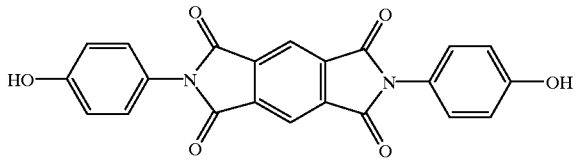

(Vc)

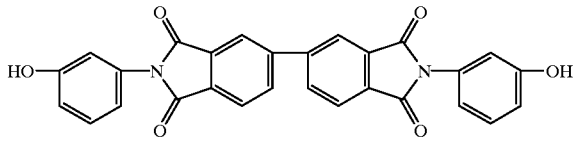

(Vd)

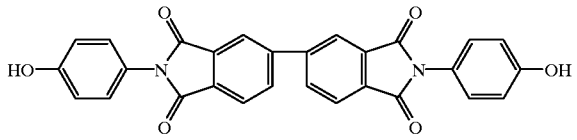

-continued (Ve)

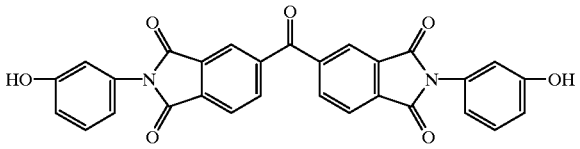

(Vf)

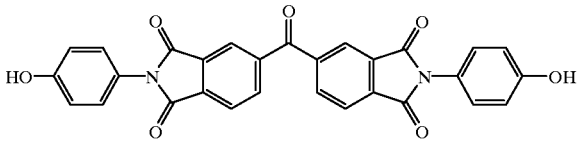

Generally, the poly(imide-carbonate) is present as a resin binder in various effective amounts, such as for example from about 30 to about 80 percent by weight, and preferably from about 50 to about 75 percent by weight with respect to the charge transport component, and wherein the total of binder and charge transfer component is equal to about 100 percent.

In embodiments thereof, the imaging members of the present invention generally possess broad spectral response to white light, or specifically to red, green and blue light emitting diodes and stable electrical properties over extended cycling times. Also, in embodiments the imaging members of the present invention can exhibit excellent charge acceptance of, for example, in excess of about 800 volts surface potential, a dark decay of, for example, less than about 50 volts per second, for example about 5 to about 45, photosensitivities ranging from $E_{1/2}$ of less than about 3 ergs/cm$^2$, for example about 2.5 to about 20 ergs/cm$^2$. Further, the imaging members of the present invention can be selected with red blue and green LED lasers, for digital systems, and for upgraded visible light systems and machines, and imaging members are comprised of, for example, in the sequence order indicated, a conductive substrate, a photogenerating layer dispersed in a resinous binder composition, and a charge transport layer, which comprises charge transporting molecules dispersed in a poly(imide-carbonate); or the photoconductive imaging members may comprise a substrate, a hole transport layer comprising a hole transport composition, such as an aryl amine, dispersed in a poly(imide-carbonate) and as a top protective polymer layer; or a member comprised of a conductive substrate, a hole blocking metal oxide layer, an optional adhesive layer, a photogenerating layer optionally dispersed in a resinous binder composition, and an aryl amine hole transport layer comprising aryl amine hole transport molecules dispersed in a poly(imide-carbonate) resinous binder.

The substrate can be comprised of various suitable components, for example it can be formulated entirely of an electrically conductive material, or it can be comprised of an insulating material having an electrically conductive surface. The substrate can be of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of a minimal thickness. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to about 100 centimeters, although the thickness can be outside of this range. When a flexible electrophotographic imaging member is desired, the thickness typically is, for example, from about 100 Angstroms to about 750 Angstroms. The substrate can be of any other conventional material, including organic and inorganic materials, such as insulating nonconducting materials such as various resins known for this purpose including polycarbonates, polyamides, polyurethanes, paper, glass, plastic, polyesters, such as MYLAR® (available from E.I. DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

An optional intermediate adhesive layer may be situated between the substrate and subsequently applied layers to, for example, improve adhesion. When such adhesive layers are utilized, they preferably have a dry thickness of, for example, from about 0.1 micron to about 5 microns, although the thickness can be outside of this range. Typical adhesive layers include film-forming polymers such as polyester, polyvinylbutyral, polyvinylpyrrolidone, polycarbonate, polyurethane, polymethylmethacrylate, and the like as well as mixtures thereof. Since the surface of the substrate can be a metal oxide layer or an adhesive layer, the expression substrate is intended to also include a metal oxide layer with or without an adhesive layer on a metal oxide layer. Moreover, other known layers may be selected for the photoconductive imaging members of the present invention, such as polymer protective overcoats, a blocking layer usually situated on the substrate, and the like.

The photogenerating layer is of an effective thickness, for example, of from about 0.05 micron to about 10 microns or more, and in embodiments has a thickness of from about 0.1 micron to about 3 microns. The thickness of this layer can be dependent primarily upon the concentration of photogenerating material in the layer, which may generally vary from about 5 to 100 percent. The 100 percent value generally occurs when the photogenerating layer is prepared by vacuum evaporation of the pigment. When the photogenerating material is present in a binder material, the binder contains, for example, from about 25 to about 95 percent by weight of the photogenerating material, and preferably contains about 60 to 80 percent by weight of the photogenerating material. Generally, it is desirable to provide this layer in a thickness sufficient to absorb about 90 to about 98 percent or more of the incident radiation which is directed upon it in the imagewise or printing exposure step. The maximum thickness of this layer is dependent primarily upon factors, such as mechanical considerations, such as the specific photogenerating compound selected, the thicknesses of the other layers, and whether a flexible photoconductive imaging member is desired.

Typical transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed.

Hole transport molecules of the type described in U.S. Pat. Nos. 4,306,008; 4,304,829; 4,233,384; 4,115,116; 4,299,897; 4,081,274, and 5,139,910, the disclosures of each are totally incorporated herein by reference, can be selected for the imaging members of the present invention. Typical diamine hole transport molecules include N,N'-diphenyl-N,N'-bis(3-methylphenyl)-(1,1-biphenyl)-,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-(1,1'-biphenyl)-4,4'-diamine, N,N'-diphenyl-N,N'-bis(4-chlorophenyl)-(1,1'-biphenyl)-4,4'-diamine, N,N'-diphenyl-N,N'-bis(phenylmethyl)-(1,1'-biphenyl)-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

In embodiments of the present invention, the preferred hole transport layer, since it, for example, enables excellent consistent effective transport of charges, is comprised of aryldiamine components as represented, or essentially represented, by the general formula of

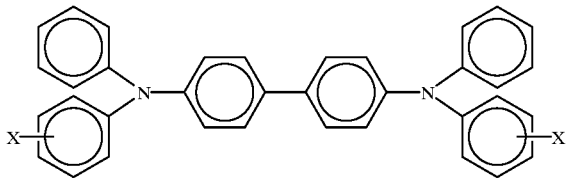

for example, the U.S. patents indicated herein, such as U.S. Pat. No. 4,265,990, wherein X and Y are selected from the group consisting of hydrogen, an alkyl group with, for example, from 1 to about 25 carbon atoms and a halogen, preferably chlorine, and at least one of X and Y is independently an alkyl group or chlorine. Specific examples include N,N'-diphenyl-N,N'-bis(alkylphenyl)-(1,1'-biphenyl)-4,4'-diamine wherein alkyl is, for example, methyl, ethyl, propyl, n-butyl, or the like, or N,N'-diphenyl-N,N'-bis (chlorophenyl)-(1,1'-biphenyl)-4,4'-diamine.

The charge transport component is present in the charge transport layer in an effective amount as indicated herein, and for example, generally from about 5 to about 90 percent by weight, preferably from about 20 to about 75 percent by weight, and more preferably from about 30 to about 60 percent by weight, although the amount can be outside of these ranges.

Examples of the highly insulating and transparent resinous components or inactive binder resinous material for the photogenerating layer include binders such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. Generally, the resinous binder contains from about 20 to about 100 percent by weight of the photogenerating pigment and preferably from about 80 percent to about 90 weight percent. Also, the binder for the photogenerating layer can be the poly(imide-carbonates) illustrated herein.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less equal to about or less than about 50 Angstroms to about 10 microns, and preferably being no more than about 2 microns.

In addition, the photoconductive imaging member may also optionally contain a second adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 micron.

The present invention also encompasses imaging and printing devices and methods for generating images with the photoconductive imaging members disclosed herein. One method comprises generating an electrostatic latent image on a photoconductive imaging member of the present invention, developing the latent image with a toner comprised of resin, colorant like carbon black, and a charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate, such as paper, may be by any method, including those wherein a corotron or a biased roll is selected. The fixing may be performed by means of any suitable method, such as flash fusing, heat fusing, pressure fusing, vapor fusing, and the like. Any substrate selected for xerographic copiers and printers, including digital copiers, may be used as a substrate, such as paper, transparency, and the like.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

Synthesis of Polymer (IIIa with x=0.95, v=0.05):

To a 5 liter round bottomed flask were charged 218.12 grams of 1,2,4,5-benzenetetracarboxylic dianhydride, 240.09 grams of 3-aminophenol and 2.5 liter of acetic acid, and the mixture was stirred at 110° C. for 6 hours. The resulting mixture was cooled down to room temperature (25° C.). The resulting yellowish solid was collected by filtration and then stirred in 2.5 liters of methanol at room temperature (25° C.). The solid was collected by filtration, and was recrystallized from dimethylformaldehyde to provide 384 grams of bis(imidephenol) (Va) product in 95.9 percent isolated yield after drying in a vacuo for 48 hours at 150° C.

$^1$H-NMR ($CDCl_3$): δ 8.8 (s, 2H), 8.2 (s, 2H), 3.6 (t, J=, 2H), 6.9 (m, 6H)

IR (KBr): 1,702 and 1,774 (C═O) $cm^{-1}$, 3,451 and 3,330 (OH) $cm^{-1}$.

A mixture of bisphenol Z (25.494 grams), benzyltriethyl ammonium chloride (0.2279 grams), 200 grams of 3 percent NaOH solution and dichloromethane (300 milliliter) was mechanically stirred in a 2 liter flask equipped with a mechanical stir. A triphosgene solution (11.870 grams in 40 milliliters of $CH_2Cl_2$) was added slowly to the mixture. Subsequently, tribultylamine (0.10 gram) and bis (imidephenol) (Va) (2.002 grams) in 100 grams of 2 percent NaOH solution were slowly added, respectively. More NaOH solution (10 percent) was added to keep the solution pH at about 9. The mixture was stirred for 30 minutes. 300 Milliliters of $CH_2Cl_2$ were added, and the mixture was transferred into a 2 liter separatory funnel and permitted to phase separate overnight, about 18 hours. The organic layer was collected and added dropwise into 3 liters of stirring methanol. The precipitated polymer was collected by filtration and dried in an oven at 60° C. under vacuum overnight. The polymer product was dissolved in 700 milliliters of $CH_2Cl_2$, and precipitated again from 3 liters of methanol. The precipitated polymer product was washed with 2.5 liters of methanol, and dried in an oven at 60° C. under house vacuum overnight to give 22.5 grams of (IIIa) in 78 percent isolated yield.

IR (film): 1,775 and 1,732 (C=O) $cm^{-1}$.

EXAMPLE II

Synthesis of Polymer (IIIa with x=0.92, v=0.08):

A mixture of bisphenol Z (4.9378 grams), benzyltriethyl ammonium chloride (0.0456 gram), 40 grams of 3 percent NaOH solution and dichloromethane (50 milliliters) was magnetically stirred in a 250 milliliter flask. A triphosgene solution (2.374 grams in 16 milliliters of $CH_2Cl_2$) was added slowly to the mixture. Subsequently, tributylamine (0.05 gram) and bis(imidephenol) (Va) (0.6406 gram) in 20 grams of 2 percent NaOH solution were slowly added, respectively. Further, NaOH solution (10 percent) was added to retain the solution at a pH of about 9. The mixture was stirred for 30 minutes. 50 Milliliters of $CH_2Cl_2$ were added, and the mixture was transferred into a 500 milliliter separatory funnel and permitted to phase separate overnight. The organic layer was collected and added dropwise into 500 milliliters of stirring methanol. The precipitated polymer was collected by filtration and dried in an oven at 60° C. under house vacuum overnight. The polymer product was dissolved in 100 milliliters of $CH_2Cl_2$, and precipitated again from 500 milliliters of methanol. The precipitated polymer product was washed with 1 liter of methanol, and dried in an oven at 60° C. under house vacuum overnight to provide 4.90 grams of (ma) in 88 percent isolated yield.

IR (film): 1,775 and 1,732 (C=O) $cm^{-1}$

EXAMPLE III

Synthesis of Polymer (IIIc with x=0.90, v=0.10):

A mixture of bisphenol Z (2.4152 grams), benzyltriethyl ammonium chloride (0.02274 gram), 20 grams of 3 percent NaOH solution and dichloromethane (25 milliliters) was magnetically stirred in a 250 milliliter flask. A triphosgene solution (1.187 grams in 8 milliliter of $CH_2Cl_2$) was added slowly to the mixture. Subsequently, tributylamine (0.03 gram) and bis(imidephenol) (Va) (0.4825 gram) in 10 grams of 2 percent NaOH solution were slowly added, respectively. Further, NaOH solution (10 percent) was added to retain the solution at a pH of about 9. The mixture was stirred for 30 minutes. 25 Milliliters of $CH_2Cl_2$ were added, and the mixture was transferred into a 250 milliliter separatory funnel and permitted to phase separate overnight. The organic layer was collected and added dropwise into 300 milliliters of stirring methanol. The precipitated polymer was collected by filtration and dried in an oven at 60° C. under house vacuum overnight. The polymer product was dissolved in 60 milliliters of $CH_2Cl_2$, and precipitated again from 300 milliliters of methanol. The precipitated polymer product was washed with 800 liters of methanol, and dried in an oven at 60° C. under house vacuum overnight to give 2.59 grams of IIIc in 89.4 percent isolated yield.

IR (film): 1,774 and 1,728 (C=O) $cm^{-1}$

EXAMPLE IV

An illustrative photoresponsive imaging device of the present invention was fabricated as follows.

A charge blocking layer was fabricated from a coating solution of 54 weight percent of n-butanol, 2.6 weight percent of polyvinyl butnone, 38.2 weight percent of zirconium butoxide and 5.2 weight percent of gama-aminopropylsilane. An aluminum drum substrate of 30 millimeters diameter was dip-coated from a dip-coating tank containing the coating solution at a pull rate of 120 millimeters per minute and dried at a temperature of 120° C. for 30 minutes. The resulting dry blocking layer has a thickness of about 1 micrometer. A charge generator coating dispersion was prepared by dispersing 22 grams of 0.4 micrometer chlorogallium phthalocyanine particles in a solution of 10 grams (VMCH) (available from Union Carbide Company) in 368 grams of 1:1 mixture of xylene and n-butanol by weight. This dispersion was milled in a Dynomill mill (KDL, available from GlenMill) with 0.4 micrometer zirconium balls for 4 hours. The drum with the charge blocking layer was then dip-coated with the charge generator coating dispersion at a pull rate of 20 centimeters per minute. The resulting coated drum was air dried to form a 0.5 micrometer thick charge generating layer. A charge transport layer coating solution was prepared from 40 grams of N,N'-diphenyl-N,N'-bis(3-methylphenyl)-[1,1'-biphenyl]-4,4'-diamine and 60 grams of poly(imide-carbonate) (IIIa) of Example I dissolved in a solvent mixture containing 80 grams of monochlorobenzene and 320 grams of tetrahydrofuran. The charge transport coating solution was applied onto the coated drum by similar dip-coating procedure as the photogenerating layer above at a pull rate of 150 centimeters per second. The coated drum was dried at 110° C. for 20 minutes to form a 24 micrometer thick charge transport layer.

For comparison, a reference imaging device was prepared in the same manner by substituting poly(imide-carbonate) with polycarbonate (Z) (PCZ 400 available from Mitsubishi Chemical Company) as the transport layer binder.

The xerographic electrical properties of the imaging members were determined by electrostatically charging their surfaces with a corona discharging device in the dark until the surface potential, as measured by a capacitively coupled probe attached to an electrometer, attained an initial value ($V_o$) of about 800 volts. After resting for 0.5 second in the dark, the charged member reached a certain surface potential referred to as dark development potential ($V_{ddp}$), and was then exposed to light from a filtered xenon lamp. A reduction in the surface potential to a background potential ($V_{bg}$) due to photodischarge effect was observed. The dark decay in volt/second was calculated as $(V_o-V_{ddp})/0.5$. The percent photodischarge was calculated as 100 percent$\times(V_{ddp}-V_{bg})/V_{ddp}$. The light energy used to photodischarge the imaging member during the exposure step was measured with a light meter. The photosensitivity of the imaging member can be described in terms of $E_{1/2}$, which refers to the amount of exposure energy in erg/$cm^2$ required to achieve 50 percent photodischarge from the dark development potential. The higher the photosensitivity, the smaller the $E_{1/2}$ value. High charge acceptance, low dark decay, and high photosensitivity (lower $E_{1/2}$ value) are desired for the improved performance of xerographic imaging members.

An illustrative wear test on the drum photoreceptors was accomplished as follows.

The photoreceptor wear was determined by the difference in the thickness of photoreceptor before and after the wear test. For the thickness measurement, the photoreceptor was mounted onto a sample holder to zero the permascope at the uncoated edge of the photoreceptor. Then its thickness was measured at every one-inch interval from the top edge of the coating along its length using a permascope, ECT-100, to obtain an average thickness value. For the wear test, the photoreceptor drum was mounted in the xerographic customer replacement unit (CRU) and set into the wear test fixture for 100,000 cycle wear test. The wear test fixture consisted of a CRU, power supplies for BCR, development roll (DR), a LED for light exposure, and a control unit to control the charging times of BCR, DR and LED and the rotation of the photoreceptor test device. The CRU consisted of a photoreceptor, cleaning blade, a BCR, a DR, and a toner cartridge. The timing was set such that the photoreceptor was rotated for 10 cycles in 8 seconds and off (stop the rotation) for 1 second. During the 10 cycle rotation, the BCR was powered with a 2,100 volt peak to peak AC voltage with a −450 volt DC bias. The DR was on for 300 msec after the BCR charging was on. The LED was turned on for 500 msec, 2 seconds after the DR was turned on. Therefore, for each 10 cycle run, the photoreceptor was charged to −450 volts surface voltage for close to 8 seconds and developed with black toners of a styrene n-butylmethacrylate resin and carbon black, REGAL 3300, and then cleaned with a blade. The 10 cycle experiment was repeated for 10,000 times such that the photoreceptor was subject to a total of 100,000 cycles in the wear fixture.

The following table summarizes the electrical and wear test results of the imaging device. The exposure light used was at a wavelength of 620 or 500 nanometers.

| Device | $V_{ddp}$ (V) | E½ Ergs/cm$^2$ | Dark Decay (V @ 500 ms) | Vr (V) | Wear (nm/k cycles) |
|---|---|---|---|---|---|
| Control Device | 814 | 1.52 | 8.9 | 7.06 | 60–100 |
| Poly(imide carbonate) CTL Binder | 814 | 1.58 | 7.3 | 4.18 | 30–50 |

CTL = Change transport layer
Vr = residual voltage

EXAMPLE V

A photoresponsive imaging device incorporating a charge transport layer using poly(imide-carbonate) binder (IIIa) of Example II as the binder was prepared in accordance with the procedure of Example IV. The following table summarizes the electrical and wear test performance of this device:

| Device | $V_{ddp}$ (V) | E½ Ergs/cm$^2$ | Dark Decay (V @ 500 ms) | Vr (V) | Wear (nm/k cycles) |
|---|---|---|---|---|---|
| Control Device | 814 | 1.52 | 8.9 | 7.06 | 60–100 |
| Poly(imide carbonate) CTL Binder | 802 | 1.51 | 11.4 | 7.84 | 20–40 |

EXAMPLE VI

A photoresponsive imaging device incorporating a charge transport layer using poly(imide-carbonate) binder (IIIc) of Example m as the binder was prepared in accordance with the procedure of Example IV. The following table summarizes the electrical and wear test performance of this device:

| Device | $V_{ddp}$ (V) | E½ Ergs/cm$^2$ | Dark Decay (V @ 500 ms) | Vr (V) | Wear (nm/k cycles) |
|---|---|---|---|---|---|
| Control Device | 814 | 1.52 | 8.9 | 7.06 | 60–100 |
| Poly(imide carbonate) CTL Binder | 802 | 1.55 | 12.0 | 7.00 | 20–40 |

The imaging members of the invention exhibited high charge acceptance levels, low dark decay ranging from about 4 to 25 volts per second, and high photosensitivity with $E_{1/2}$ ranging from about less than 3 ergs/cm$^2$ to about 15 ergs/cm$^2$. The members or devices also displayed enhanced wear resistance when compared to the control member or device.

Other embodiments and modifications of the present invention may occur to those skilled in the art subsequent to a review of the information presented herein; these embodiments, modifications, and equivalents thereof, are also included within the scope of the present invention.

What is claimed is:

1. A photoconductive imaging member comprised of a photogenerating layer and a charge transport layer, and wherein the charge transport layer contains a poly(imide-carbonate) resin binder of (I) or (II)

(I)

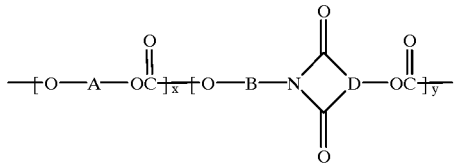

(II)

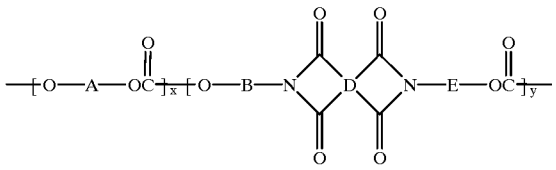

wherein A, B and E are divalent linkages; D is a trivalent linkage in (I) and a tetravalent linkage in (II); and x and y represent mole fractions wherein the sum of x+y is equal to 1.

2. A photoconductive imaging member in accordance with claim 1 wherein A, B and E are independently selected from the group consisting of alkylene, arylene, diarylene, alkylenearyl, bis(arylene)alkane, and bis(arylene)sulfide; and D is a trivalent or tetravalent aromatic moiety.

3. A photoconductive imaging member in accordance with claim 1 wherein the poly(imide-carbonate) binder is represented by (in)

(III)

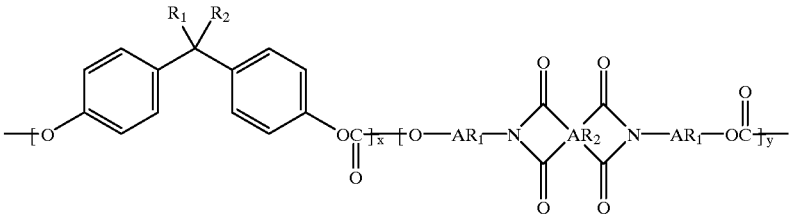

wherein $R_1$ and $R_2$ are independently selected from the group consisting of hydrogen, alkyl, substituted alkyl, aryl, and substituted aryl; $Ar_1$ is arylene, or substituted arylene; and $Ar_2$ is a tetravalent aromatic linkage.

4. A photoconductive imaging member in accordance with claim 3 wherein $R_1$ and $R_2$ are alkyl containing from about 1 to about 10 carbon atoms, and wherein $Ar_1$ is arylene containing from about 7 to about 20 carbon atoms.

5. A photoconductive imaging member in accordance with claim 4 wherein $Ar_1$ is selected from the group consisting of the following

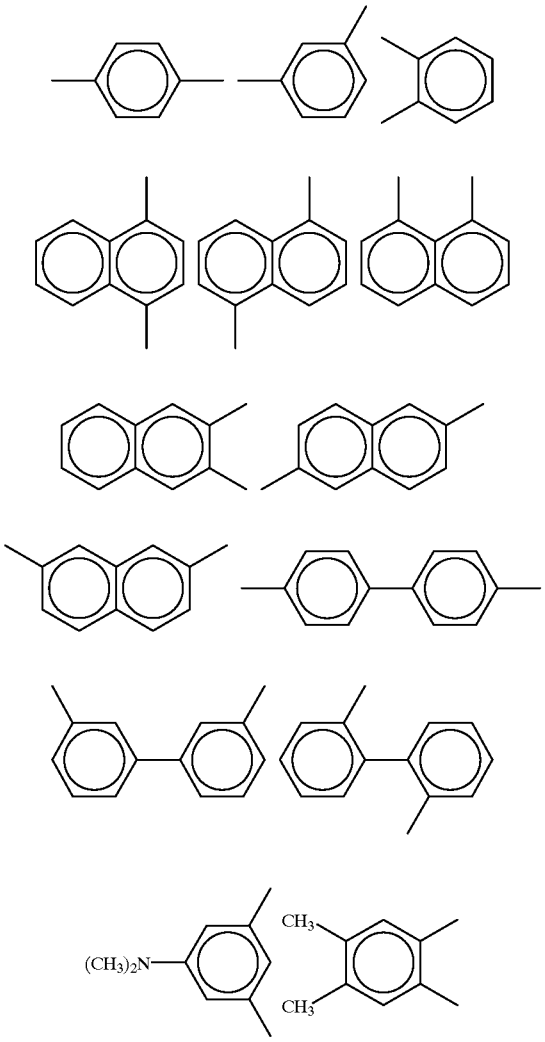

-continued

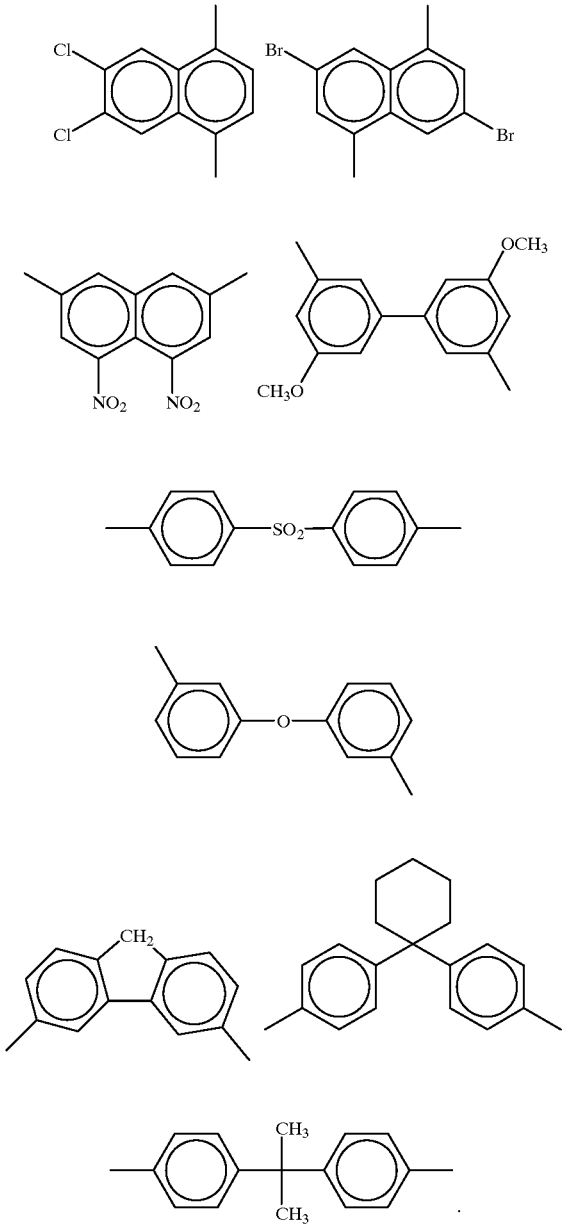

6. A photoconductive imaging member in accordance with claim 1 wherein said poly(imide-carbonate) is selected from the group consisting of (IIIa) through (IIIj)

(IIIa)
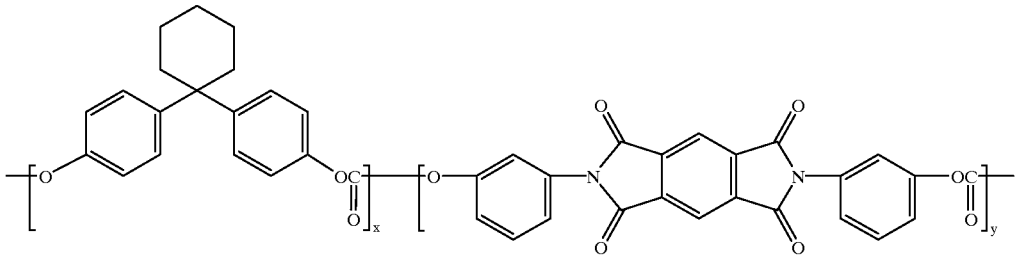
(IIIb)
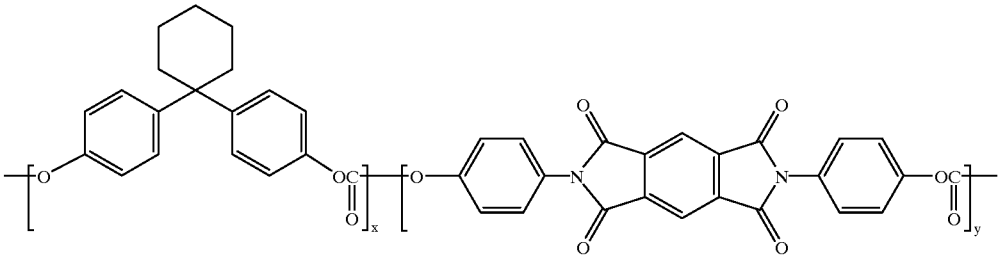
(IIIc)
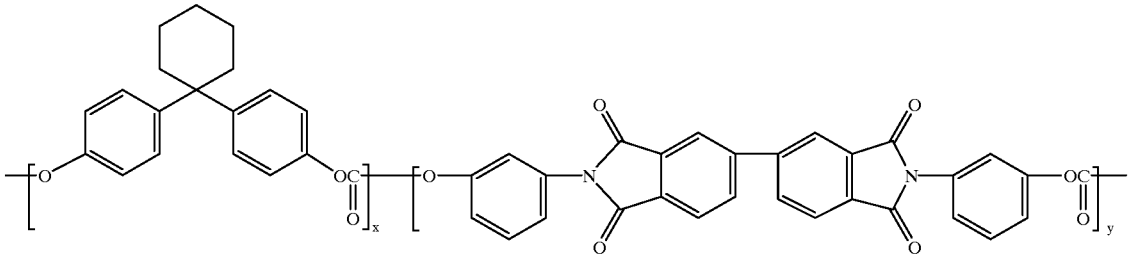
(IIId)
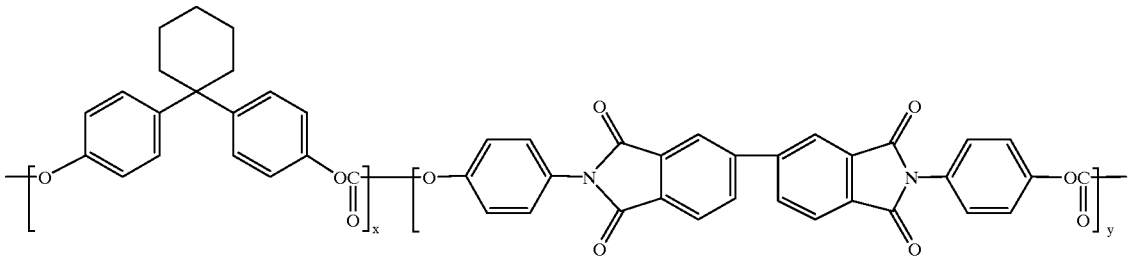
(IIIe)
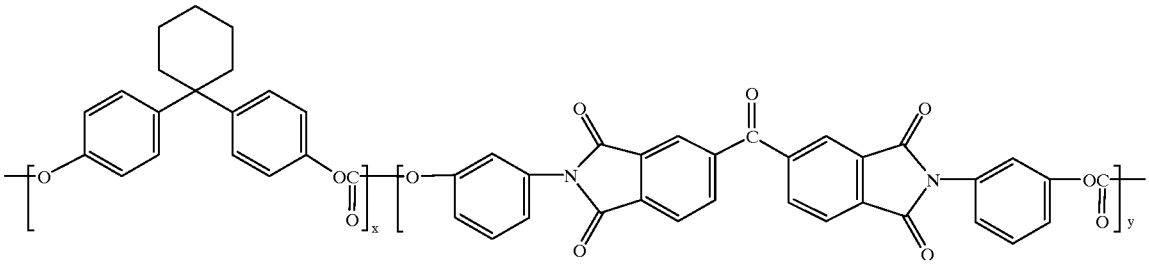

-continued
(IIIf)
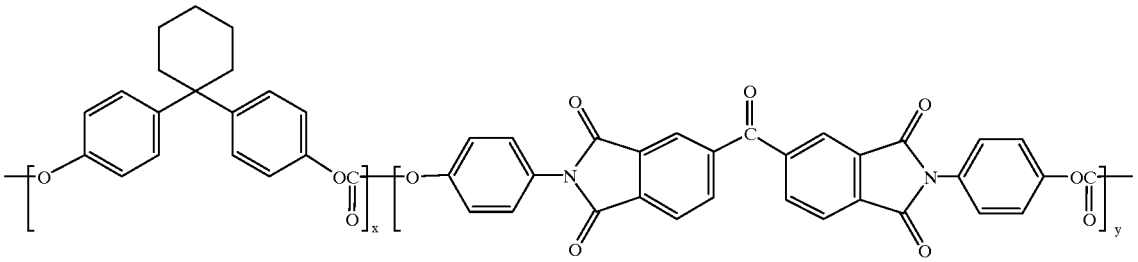
(IIIg)
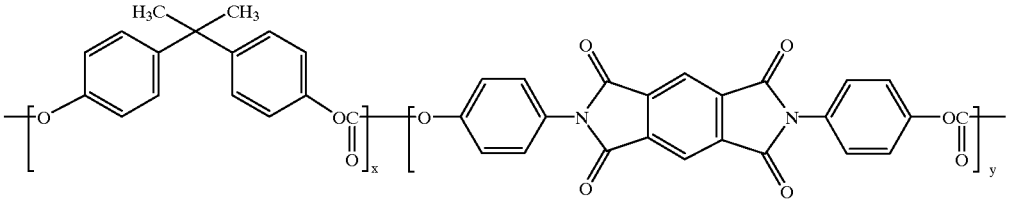
(IIIh)
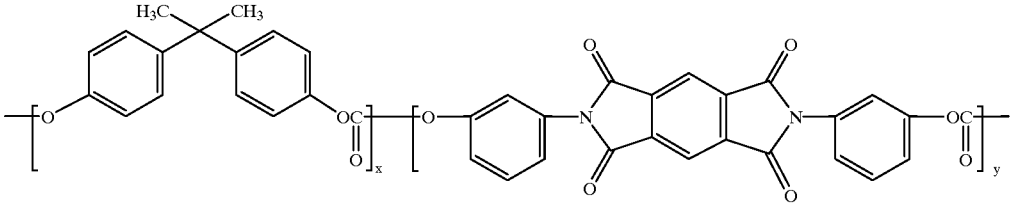
(IIIi)
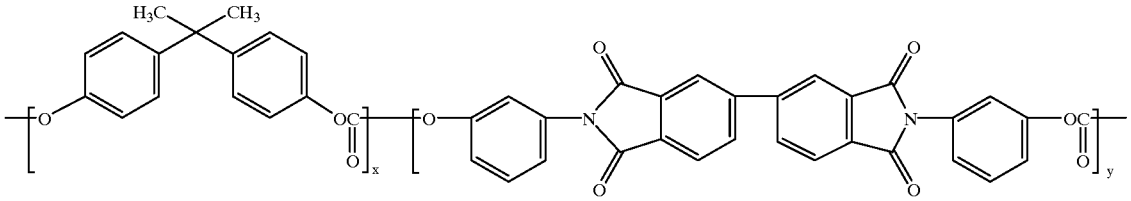
(IIIj)
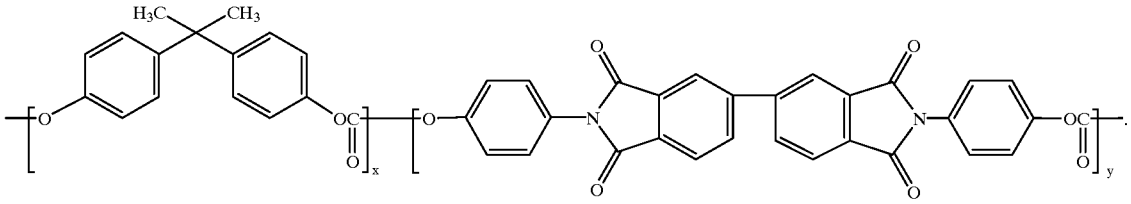
7. A photoconductive imaging member in accordance with claim 1 wherein said poly(imidecarbonate) is selected from the group consisting of
(IIIf)
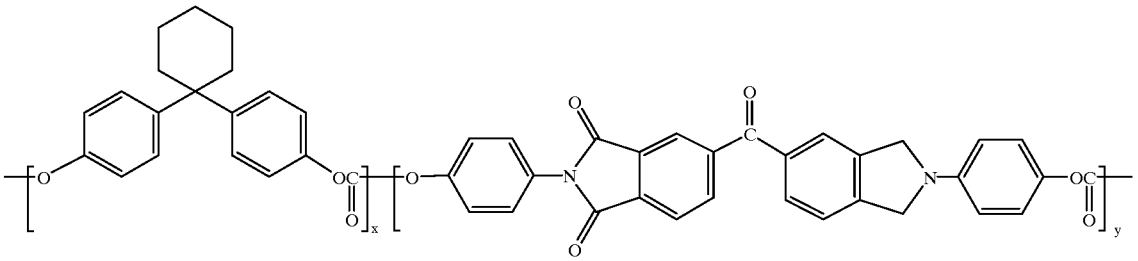

-continued (IIIg)

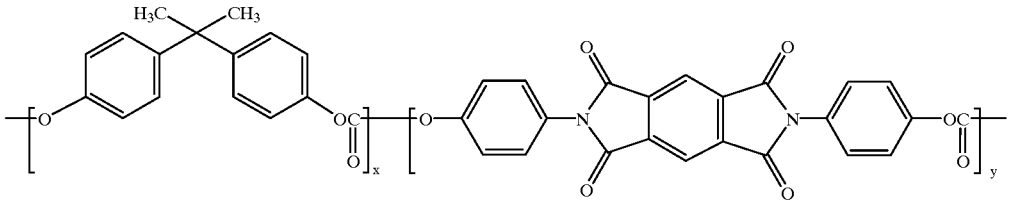

(IIIh)

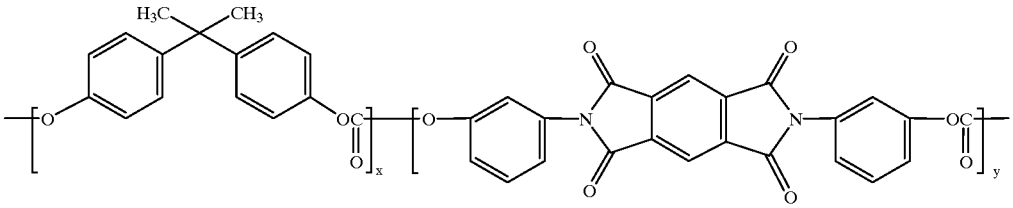

(IIIi)

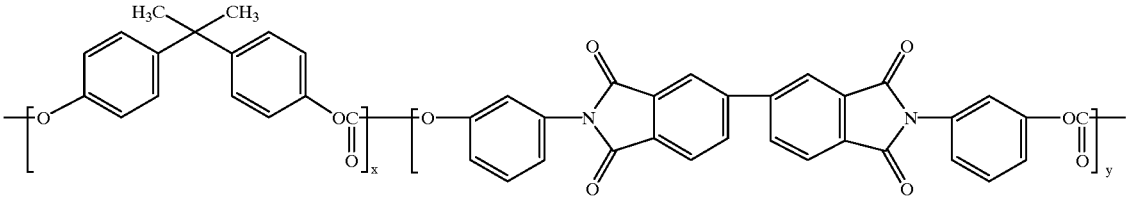

(IIIj)

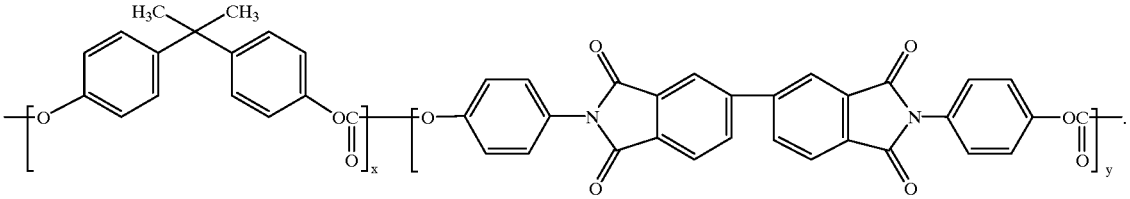

8. A photoconductive imaging member in accordance with claim 1 wherein said poly(imide-carbonate) is present in an amount of from about 25 to about 70 weight percent, and the total amount of said poly(imide-carbamate) and said charge transport component equals about 100 percent; or said poly(imide-carbonate) is present in an amount of from about 40 to about 55 weight percent, and the total amount of said poly(imide-carbamate) and said charge transport molecules equals about 100 percent.

9. A photoconductive imaging member in accordance with claim 1 wherein said poly(imide-carbonate) possesses a weight average molecular weight, $M_w$, of from about 30,000 to about 500,000, and wherein said poly(imide-carbonate) optionally possesses a number average molecular weight, $M_n$, of from about 5,000 to about 100,000.

10. A photoconductive imaging member in accordance with claim 8 wherein said poly(imide-carbonate) is of the formulas (IIIa) through (IIIj)

(IIIa)

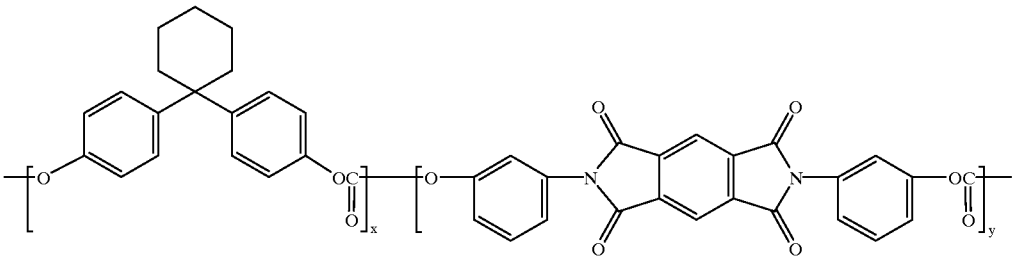

-continued
(IIIb)
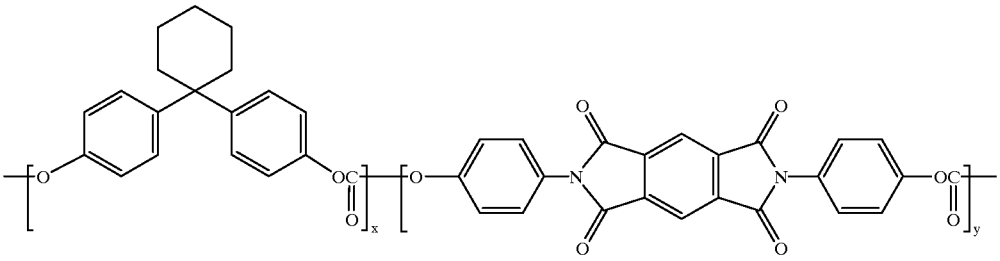
(IIIc)
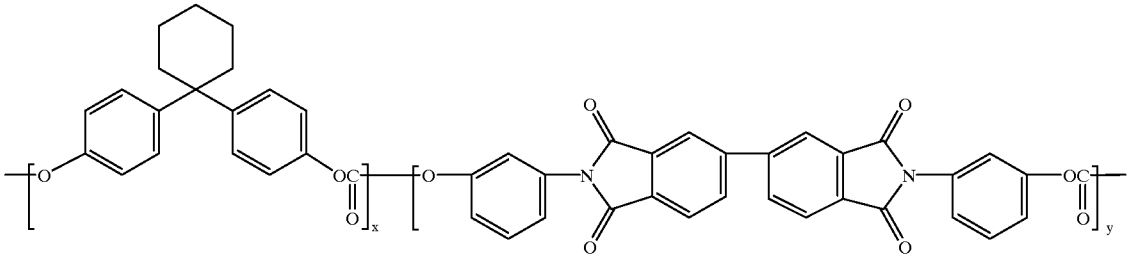
(IIId)
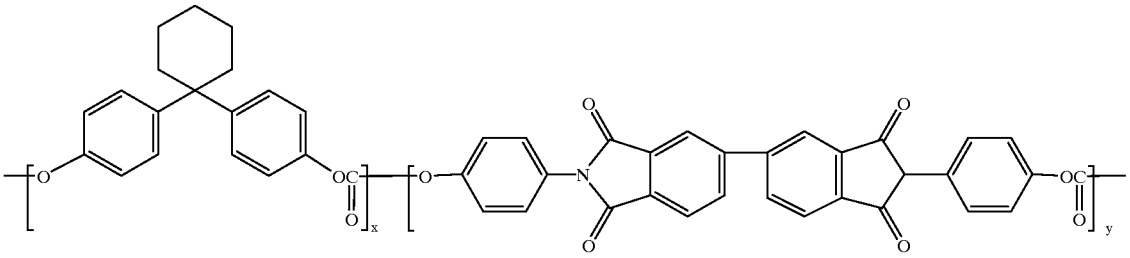
(IIIe)
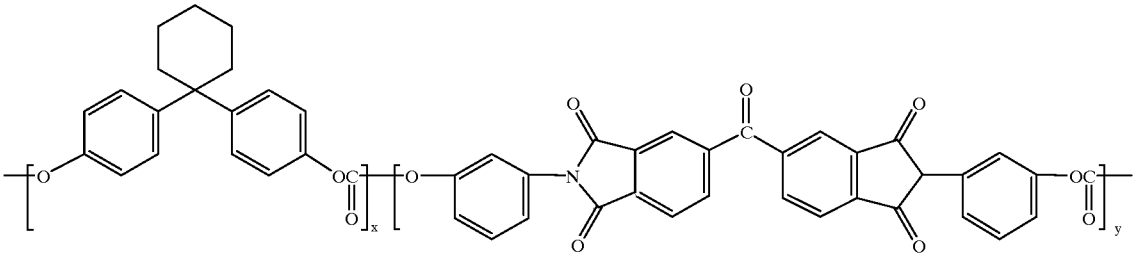
(IIIf)
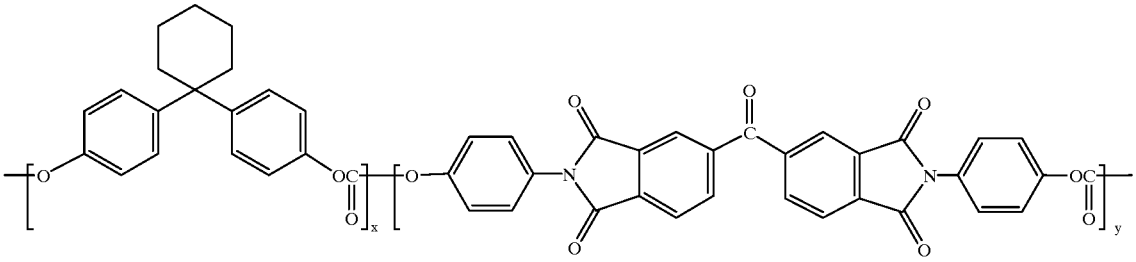

-continued (IIIg)

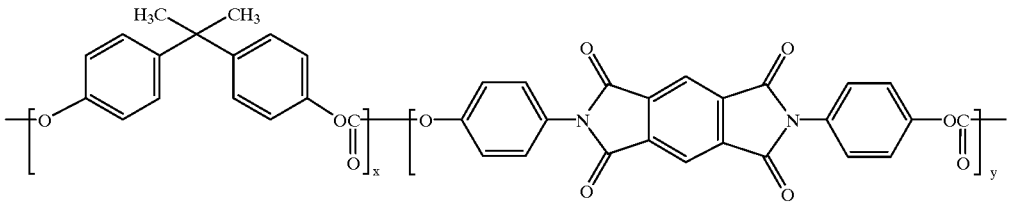

(IIIh)

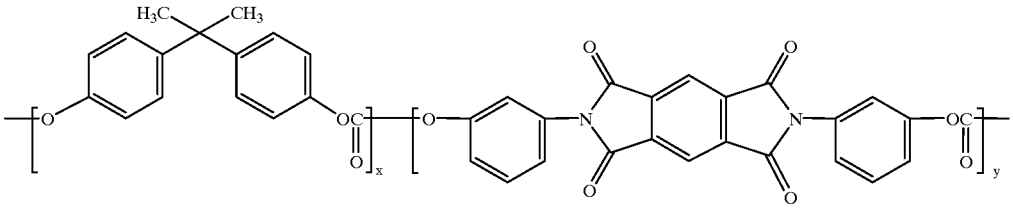

(IIIi)

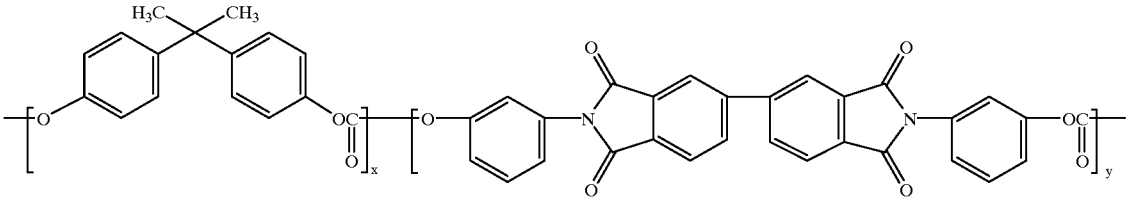

(IIIj)

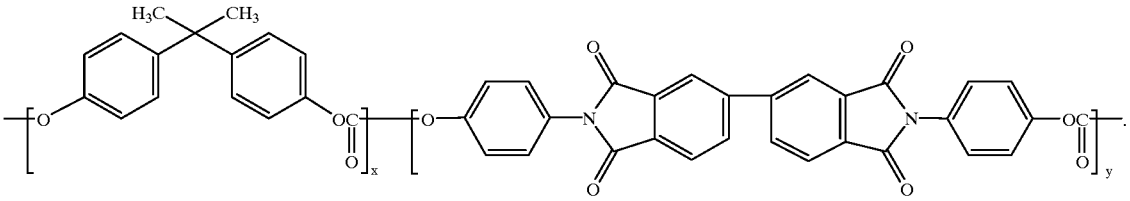

11. A photoconductive imaging member in accordance with claim 1 wherein said photogenerating layer is comprised of photogenerating pigments selected from the group consisting of metal phthalocyanines, metal free phthalocyanines, perylenes, titanyl phthalocyanines, selenium, and hydroxygallium phthalocyanines optionally dispersed in a resin binder.

12. A photoconductive imaging member in accordance with claim 11 wherein said binder is a poly(imide-polycarbonate).

13. A photoconductive imaging member in accordance with claim 11 wherein said photogenerating layer is comprised of pigments of a perylene of the formula

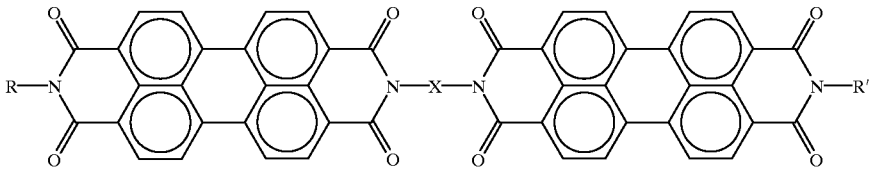

wherein each R and R' is independently selected from the group consisting of hydrogen, alkyl, substituted alkyl, aryl, substituted aryl, and X represents a bridging linkage.

14. A photoconductive imaging member in accordance with claim 13 wherein X is alkylene, substituted alkylene, arylene, or substituted arylene.

15. A photoconductive imaging member in accordance with claim 1 wherein said photogenerating layer is comprised of pigments of a perylene or mixtures thereof selected from the group consisting of

18. A photoconductive imaging member in accordance with claim 1 wherein the photogenerator layer component is dispersed in a resinous binder in an amount of from about 5 percent to about 95 percent by weight, and optionally wherein the resinous binder is a polyester, a polyvinylcarbazole, a polyvinylbutyral, a polycarbonate, a polyether carbonate, an aryl amine polymer, a styrene copolymer, or a phenoxy resin, and wherein the charge transport layer is comprised of aryl amines dispersed in said poly(imide-carbonate) binder.

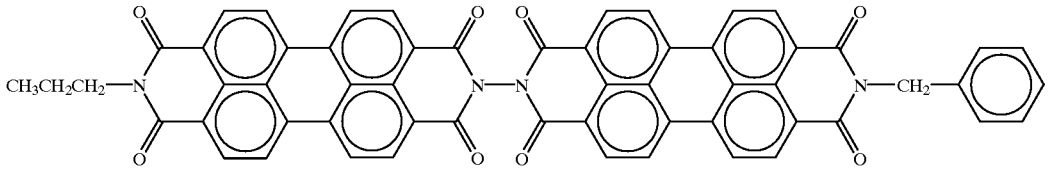

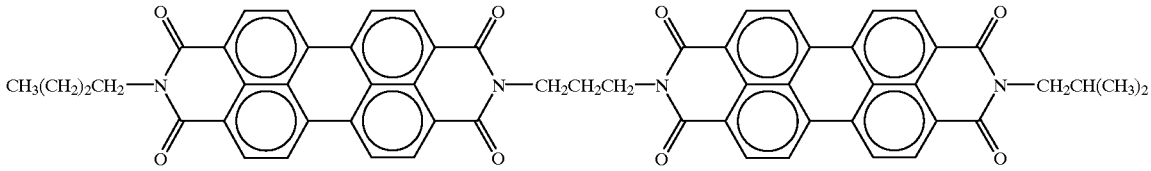

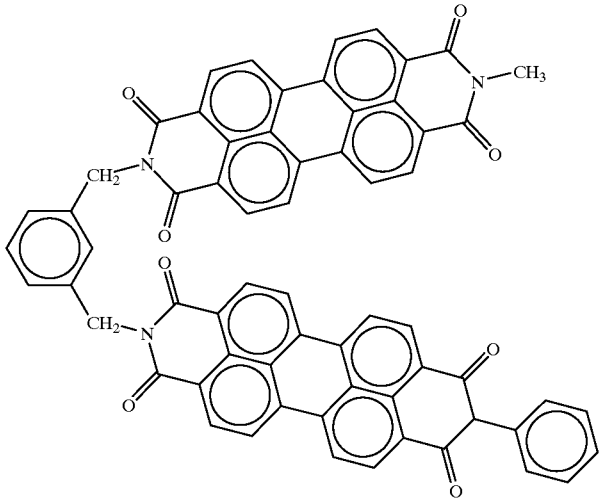

16. A photoconductive imaging member in accordance with claim 1 and containing a supporting substrate in contact with the photogenerating layer, or containing a supporting substrate in contact with the charge transport layer.

17. A photoconductive imaging member in accordance with claim 16 wherein the supporting substrate is a metal, a conductive polymer, or an insulating polymer, each with a thickness of from about 30 microns to about 300 microns optionally overcoated with an electrically conductive layer with an optional thickness of from about 0.01 micron to about 1 micron, and wherein there is further optionally included an overcoating polymer top layer on said member.

19. A photoconductive imaging member in accordance with claim 1 wherein the photogenerating layer is of a thickness of from about 0.2 to about 10 microns, wherein the charge transport layer is of a thickness of from about 10 to about 100 microns, and wherein there is included a supporting substrate overcoated with a polymeric adhesive layer of a thickness of from about 0.01 to about 1 micron.

20. A photoconductive imaging method comprising the formation of a latent image on the photoconductive imaging member of claim 1, developing the image with a toner composition comprised of resin and colorant, transferring the image to a substrate, and optionally fixing the image thereto.

21. A photoconductive imaging member in accordance with claim 3 wherein said $Ar_2$ is a monocyclic linkage derived from pyromellitic acid, or a bicyclic linkage derived from biaryl-, benzophenone-, diarylsulfide, or diaryl sulfone tetracarboxylic acids.

22. A photoconductive imaging member in accordance with claim 1 wherein A, B and E are alkylene containing from about 1 to about 26 carbon atoms, arylene contains from about 7 to about 30 carbon atoms, D is a trivalent linkage, x is from about 0.1 to about 0.99, and y is from about 0.1 to about 0.99, and wherein the sum of x+y is equal to 1.

23. A photoconductive imaging member in accordance with claim 1 wherein said poly(imide carbonate) is of the formula (I)

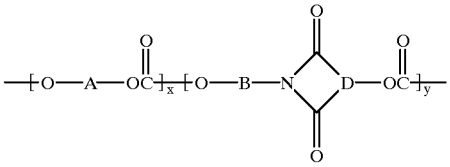

wherein D is a trivalent linkage.

24. A photoconductive imaging member in accordance with claim 1 wherein said poly(imide carbonate) is of the Formula (II)

(II)

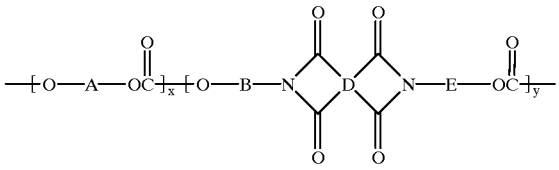

wherein D is a tetravalent linkage.

25. A photoconductive imaging member in accordance with claim 23 wherein a supporting substrate is present and said charge transport component is a hole transport.

26. A photoconductive imaging member in accordance with claim 24 wherein a supporting substrate is present and said charge transport component is comprised of hole transport materials.

* * * * *